US012178280B2

(12) United States Patent
Duemler et al.

(10) Patent No.: US 12,178,280 B2
(45) Date of Patent: Dec. 31, 2024

(54) SOLE AND SHOE WITH HAPTIC FEEDBACK

(71) Applicant: adidas AG, Herzogenaurach (DE)

(72) Inventors: Burkhard Duemler, Herzogenaurach (DE); Katharina Margaretha Gudrun Kern, Erlangen (DE); Franziska Seehausen, Berlin (DE); Roy Anthony Williamson, Nuremberg (DE)

(73) Assignee: adidas AG, Herzogenaurach (DE)

( * ) Notice: Subject to any disclaimer, the term of this patent is extended or adjusted under 35 U.S.C. 154(b) by 110 days.

(21) Appl. No.: 17/122,911

(22) Filed: Dec. 15, 2020

(65) Prior Publication Data

US 2021/0219655 A1 Jul. 22, 2021

(30) Foreign Application Priority Data

Jan. 17, 2020 (DE) ..... 10 2020 200 558.3

(51) Int. Cl.

| | |
|---|---|
| ***A43B 13/16*** | (2006.01) |
| ***A43B 13/10*** | (2006.01) |
| ***A43B 13/12*** | (2006.01) |
| ***A43B 13/18*** | (2006.01) |
| ***A43B 13/42*** | (2006.01) |
| *A43B 13/04* | (2006.01) |

(52) U.S. Cl.

CPC ..... *A43B 13/16* (2013.01); *A43B 13/10* (2013.01); *A43B 13/125* (2013.01); *A43B 13/187* (2013.01); *A43B 13/42* (2013.01); *A43B 13/04* (2013.01)

(58) Field of Classification Search

CPC ..... A43B 13/16; A43B 13/42

See application file for complete search history.

(56) References Cited

U.S. PATENT DOCUMENTS

| | | | | |
|---|---|---|---|---|
| 1,841,461 | A * | 1/1932 | Thoma | A43B 13/42 428/350 |
| 3,971,839 | A * | 7/1976 | Taylor | B29C 67/00 264/126 |
| 4,658,515 | A * | 4/1987 | Oatman | A43B 17/14 36/31 |
| 4,970,807 | A * | 11/1990 | Anderie | A43B 13/181 36/35 R |
| 5,564,202 | A | 10/1996 | Hoppenstein | |

(Continued)

FOREIGN PATENT DOCUMENTS

| | | | |
|---|---|---|---|
| CN | 108289529 | A | 7/2018 |
| CN | 108366644 | A | 8/2018 |

(Continued)

OTHER PUBLICATIONS

Office Action, Chinese Patent Application No. 202011456794.4, Jan. 13, 2022, 13 pages.

(Continued)

*Primary Examiner* — Jila M Mohandesi

(74) *Attorney, Agent, or Firm* — Kilpatrick Townsend & Stockton LLP

(57) ABSTRACT

The present invention relates to a sole for a shoe, in particular a running shoe. The shoe comprises a sole component and at least one loose particle(s) contained within the sole component. The loose particles provide haptic feedback to a user of the sole during an athletic activity.

19 Claims, 18 Drawing Sheets

(56) References Cited

U.S. PATENT DOCUMENTS

| | | | | |
|---|---|---|---|---|
| 6,782,640 | B2 * | 8/2004 | Westin | A43B 13/187 36/153 |
| 9,078,493 | B2 * | 7/2015 | Bradford | A43B 13/187 |
| 9,930,928 | B2 * | 4/2018 | Whiteman | A43B 13/188 |
| 10,136,842 | B2 | 11/2018 | Ashby | |
| 10,674,788 | B2 * | 6/2020 | Hoffer | A43B 13/04 |
| 11,096,444 | B2 * | 8/2021 | Hoffer | A43B 13/125 |
| 2006/0010717 | A1 * | 1/2006 | Finkelstein | A43B 13/187 36/43 |
| 2006/0026863 | A1 * | 2/2006 | Liu | A43B 7/08 36/25 R |
| 2006/0130363 | A1 * | 6/2006 | Hottinger | A43B 13/125 36/11.5 |
| 2008/0066341 | A1 * | 3/2008 | Hottinger | A43B 13/04 36/28 |
| 2010/0222442 | A1 * | 9/2010 | Prissok | B29B 9/16 521/56 |
| 2011/0099845 | A1 * | 5/2011 | Miller | A43B 13/18 36/91 |
| 2013/0041617 | A1 | 2/2013 | Pease et al. | |
| 2015/0197617 | A1 * | 7/2015 | Prissok | C08J 9/35 521/137 |
| 2015/0313313 | A1 | 11/2015 | Bradford | |
| 2016/0015120 | A1 * | 1/2016 | Denison | A43B 3/0094 36/114 |
| 2016/0192862 | A1 | 7/2016 | Merrell et al. | |
| 2017/0127753 | A1 | 5/2017 | Kohatsu et al. | |
| 2017/0341326 | A1 * | 11/2017 | Holmes | A43B 13/04 |
| 2018/0352900 | A1 * | 12/2018 | Hartmann | A43B 13/04 |
| 2019/0216168 | A1 | 7/2019 | Hoffer et al. | |
| 2022/0232928 | A1 * | 7/2022 | Reddy | A43B 13/187 |
| 2023/0200490 | A1 * | 6/2023 | Hoffer | A43B 1/0072 36/28 |

FOREIGN PATENT DOCUMENTS

| | | | |
|---|---|---|---|
| WO | 2014/154075 | A1 | 10/2014 |
| WO | 2020/011843 | A1 | 1/2020 |

OTHER PUBLICATIONS

Office Action, German Patent Application No. 10 2020 200 558.3, Aug. 26, 2020, 17 pages.
European Extended Search Report, European Patent Application No. 20213991.1, Jun. 9, 2021, 11 pages.
Office Action, German Patent Application No. 10 2020 200 558.3, Jan. 17, 2023, 15 pages.
Office Action, European Patent Application No. 20213991.1, Sep. 27, 2023, 7 pages.

* cited by examiner

SOLE AND SHOE WITH HAPTIC FEEDBACK

CROSS REFERENCE TO RELATED APPLICATION

This application is related to and claims priority benefits from German Patent Application No. 102020200558.3, filed on Jan. 17, 2020 ("the '558 application"). The '558 application is hereby incorporated herein in its entirety by this reference.

FIELD OF THE INVENTION

The present invention relates to a sole with haptic feedback and a shoe comprising the sole.

BACKGROUND

Staying fit and healthy is an often-desired wish of today's society. To achieve this goal, regular sporting activity has proven to be effective. One of the most popular sports to perform is running. However, little thought is given to the correct technique whilst running or jogging. On a competitive level, a good running style can result in a faster running speed and higher endurance. On an amateur level, improving running style can help to reduce the risk of injuries. However, even if an athlete is trying to improve his way of running, it is not easy to judge one's own technique without the use of an additional person, such as a coach, or expensive technical equipment, such as a video recording device. Thus, there is a need for a device, tool or sports apparel, which is adapted to provide reliable feedback about a running technique.

In the footwear industry, various solutions are available to provide a user with direct or indirect feedback. For example, prior art document U.S. Ser. No. 10/136,842 B2 discloses a sensor in a footwear apparatus, which is positioned to monitor an activity technique of the user when the footwear apparatus is joined with a foot of the user. When a poor technique is detected, pins, balls or rods may be adapted to contact the user's foot causing discomfort and thus indicating a bad technique and motivating the user to improve the technique. Prior art document US2013/0041617 A1 relates to systems and methods for monitoring athletic performance. A sensing unit, adapted to be attached to a shoe of a user, is monitoring a movement of a foot, such as a strike location. The determined performance characteristic is then transmitted to a remote receiver informing the user. Furthermore, prior art document US2016/0192862 A1 relates to a shoe-based analysis system. A sole of a shoe, having at least a portion of a foam is replaced by a self-sensing composite polymeric foam adapted to generate voltage data. The voltage data is transformed into force data, compared to a profile and fed-back to a user via vibrations, a sound, a light pattern or a visual display for a wearer of the shoe.

Most of the prior art documents disclose the usage of electric devices for determining and/or providing feedback information about the running technique. Such devices are often expensive, prone to errors, in need of maintenance and increase the ecological footprint of the user. In addition, using a feedback system in the form of pins, which are hard, stiff, static in their position can potentially provide a disturbing haptic feedback for the user. In some instances, the disturbing haptic feedback may cause injuries with the user adapting their gait to include undesired movement patterns in order to avoid the undesired haptic feedback.

It is therefore a problem underlying the present invention to provide an improved haptic feedback to a user so that the above outlined disadvantages of the prior art are at least partly overcome.

SUMMARY

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

In some aspects, the present disclosure is directed to a sole for a shoe, the sole comprising: a. a sole component; and b. at least one loose particle(s) contained within the sole component, c. wherein the loose particle(s) provides haptic feedback to a user of the sole during an athletic activity. The sole component may comprise a midsole and/or an insole. The sole component may comprise particles of an expanded material (which are fused at their surfaces; and/or wherein at least a portion of the sole component is manufactured by an additive manufacturing technique. The loose particles may be at least partially arranged within a cavity in the sole component. In some aspects, providing the haptic feedback does not involve any electronic components and/or wherein the haptic feedback comprises feedback on a region of the user's foot where foot strike occurs, feedback on a roll-off behavior of the user's foot, feedback on a stride length of the user, feedback on a stride frequency of the user, a massage effect of the user's foot or a combination thereof. The loose particles may comprise an expanded material. The expanded material may be expanded thermoplastic polyurethane (eTPU). The loose particles may comprise a metal. The loose particles may be contained within the sole component at least partly by a mesh-like material disposed on a top side of the sole component. The loose particles may be contained within the midsole at least partly by an outsole of the sole. The loose particles may be contained within a pouch made of a mesh-like material or wherein the loose particles are contained within a pouch made from a foil material. The loose particles may exhibit a different response to compression forces exerted by the foot of the user during use when compared to the surrounding material of the sole component. The loose particles may be arranged in a forefoot region of the shoe to aid the user in achieving a forefoot running strike and/or wherein the loose particles are arranged in a heel region of the shoe to aid the user in achieving a forefoot running strike. The loose particles may change the effective weight of the sole during use of the sole. The loose particles may move along the longitudinal direction of the sole and/or the loose particles may move along a medial-to-lateral direction of the sole. The outsole may comprise a mesh-like material on the side facing the midsole. The loose particles may be contained within a pouch made from a foil material and comprising a fluid. The effective weight of the sole may depend at least partially on a stride frequency of the user. In some aspects, the present disclosure is directed to a shoe comprising a sole as described in this paragraph.

BRIEF DESCRIPTION OF THE DRAWINGS

In the following detailed description, embodiments of the invention are described referring to the following figures.

BRIEF DESCRIPTION

Figure 1A:
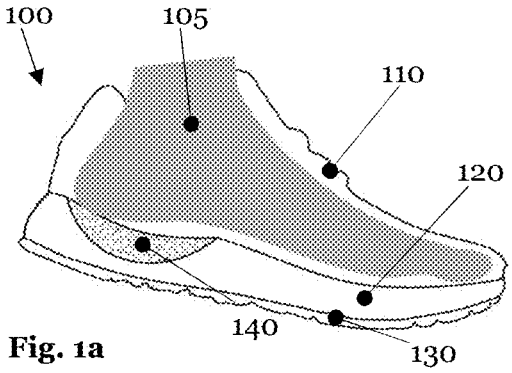
FIGS. 1*a*, 1*b*, 1*c*, 1*d*, and 1*e*: schematic illustration of embodiments of a shoe comprising loose particles and a midsole comprising loose particles.

The above-mentioned problem is at least partly solved by the subject matter of the independent claims of the present invention. Exemplary embodiments of the invention are defined in the dependent claims.

In an embodiment, the present invention provides a sole for a shoe, in particular, a running shoe, comprising a sole component and at least one loose particle(s) contained within the sole component. The loose particles provide haptic feedback to a user of the sole during an athletic activity.

The claimed invention therefore provides a sole for a shoe with an improved haptic feedback by using at least one loose particle(s) in the sole component. The loose particles provide, in a simple but effective manner, a special feedback to the user of a shoe including such a sole, which allows the user to improve the running technique. The word "loose" in the present context should be understood as meaning not directly attached to a surrounding material and each other. Thus, the at least one loose particle(s) of the claimed invention may be flexible and able to move within the sole, at least to some extent.

In some embodiments of the present invention, the sole component may comprise a midsole and/or an insole. In this manner, the present invention may provide an immediate haptic feedback resulting from loose particles in almost direct contact with a sole of a user's foot.

In some embodiments of the present invention, the sole component may comprise particles of an expanded material, which may be fused at their surfaces.

The particles of expanded material may, for example, comprise at least one of the following materials: expanded ethylene-vinyl-acetate (eEVA), expanded thermoplastic urethane (eTPU), expanded polypropylene (ePP), expanded polyamide (ePA), expanded polyether block amide (ePEBA), expanded polyoxymethylene (ePOM), expanded polystyrene (ePS), expanded polyethylene (ePE), expanded polylactide (ePLA), expanded polyethylene terephthalate (ePET), expanded polybutylene terephthalate (ePBT), and expanded thermoplastic olefin (eTPO). According to the requirement profile of the sole component, at least one of these materials may be beneficially used for the manufacture of the sole component due to their substance-specific properties. Moreover, expanded particles, in particular expanded TPU, are characterized by their good elastic and cushioning properties. On the one hand, expanded particles may be particularly cushioning. Thus, external shocks which arise for example when the shoe hits the ground may be well cushioned so that a pleasant wearing comfort is achieved. On the other hand, expanded particles can provide a large elasticity. By means of a large elasticity, the energy which is absorbed for deforming the sole is—to a large extent—released again by the sole. Thus, the major part of the energy is not lost. This may lead to a very specific haptic feedback to the athlete.

Furthermore, providing a mixture of expanded material fused at their surfaces and at least one loose particle(s) within the same sole component may provide areas of different haptic nature and/or haptic quality which leads to an even more advanced feedback to the athlete. The loose particles may comprise the same or different material as the fused particles. The different areas may be distinguishable by a user during a roll-off movement of the foot, thus leading to changing haptic feedback sensations depending on a specific composition and/or assembly of the sole component.

In some embodiments of the present invention, at least a portion of the sole component may be manufactured by an additive manufacturing technique.

The additively manufactured portion of the sole component, in particular of the midsole, may for example comprise a lattice structure, a heel element, a base portion or others. According to an embodiment, the additively manufactured portion of the sole component may be manufactured from one class of material, in particular from polyether block amide (PEBA) or from thermoplastic polyurethane (TPU). This may allow a particularly efficient manufacturing of the portion of the sole component. Alternatively, the additively manufactured portion of the sole component may also be manufactured from polyolefins, for example polyethylene (PE), polystyrene (PS) and/or polypropylene (PP). In principle, it is possible to use an arbitrary mixture of different materials (from different classes of materials or from the same class of materials with slightly different properties) for additive manufacture. By combining sole components comprising at least an additively manufactured portion and at least one loose particles within the same sole component, areas of different haptic nature and/or haptic quality similarly as described above with reference to a sole component comprising fused particles of expanded materials may be provided.

In an embodiment, the loose particles may be at least partially arranged within a cavity in the sole component. To this end, the loose particles may be at least partially embedded within the sole component, while being able to freely move around within the cavity. While all of the particles could be embedded in the sole component, also embodiments are comprised, wherein such an amount of particles are filled into the cavity of a sole that the particles extend above or below the surface of the surrounding sole material. The various amounts of filling may be used to result in an intended haptic feedback. This feedback may be optimized for an individual or for a desired feedback level (strength of feedback). For example, feedback regarding the user's running technique may be further optimised for speed of learning the technique, for example, intense feedback for a professional athlete to quickly learn ranging through to light/mild feedback for an amateur athlete just starting to run.

In some embodiments, providing the haptic feedback may not involve any electronic components. This embodiment may be particularly suitable for athletes enjoying athletic activities in harmony with the environment thinking about their ecological footprint. Additionally, as it is known that electric components, such as for example electric circuits or batteries, are negatively affected or even damaged by shocks, impacts, moisture or similar, which are common external factors for shoes during athletic activities, the above-mentioned embodiment may also provide a shoe comprising a highly durable and/or failure-insusceptible manner of providing haptic feedback. Furthermore, electronic devices require a power supply or internal battery. The need for a power source creates a burden of maintenance work for the user, for example regularly charging or changing the battery.

In some embodiments, the present invention may provide a haptic feedback comprising feedback on a region of the user's foot where foot strike occurs, feedback on a roll-off behavior of the user's foot, feedback on a stride length of the user, feedback on a stride frequency of the user, a massage effect of the user's foot, or a combination thereof. As a sole of the foot is characterized by its high density of sensory receptor cells, loose particles may be adapted and optimized for various haptic feedback sensations. Such sensations may for example be helpful in improving a running technique of a user of the shoe. Additionally or alternatively, such sensations may also, for example, help loosening tense tissue of the user's foot. In this manner, an improved recovery during and after intense training sessions may be provided by the massage effect of the loose particles within the sole component. Receiving feedback about a roll-off behavior may for example reduce injuries resulting from long-term running with a poor/non-optimised technique. Feedback about stride length and/or stride frequency may be specifically beneficial for increasing the efficiency of running or running speed. This may result in an overall performance enhancement of the runner. Feedback on a region of the user's foot where foot strike occurs may help to reduce a landing on a specific area/point of the foot.

Therefore, the above-mentioned different scenarios of haptic feedback or also various combinations thereof may help the runner to improve the running technique, increase the efficiency of running or running speed, help to recover, reduce the risk of injuries and/or also reduce the amount of energy lost due to poor/non-optimised landing and roll-off behaviour while running.

In an embodiment, the loose particles may comprise an expanded material, in particular expanded thermoplastic polyurethane (eTPU). Other expanded materials as described above with reference to expanded materials fused at their surfaces may also be applicable for the loose expanded particles. Loose expanded material provides similar to fused expanded material good cushioning and a high elasticity. Such characteristics provide various benefits in using expanded material for soles, as already described above. Furthermore, loose particles of expanded material are quiet in their movement. In addition, if the expanded material comprises TPU, the surface of the loose eTPU particles may feature a certain stickiness/roughness so that the particles may stay predominantly in place increasing the haptic sensation.

In an embodiment of the present invention, the loose particles may comprise metal or hard material. It is well known that metal comprises a relatively high specific weight compared to standard materials used for manufacture of soles, such as for example plastics or rubber materials. It is also known that loose particles are able to move freely within the provided boundaries. By combining both characteristics and thus using loose metal particles within a sole component, a haptic sensation of the shoe may be created which may specifically feedback information regarding a change in momentum or a change in direction of motion of the shoe. It may be noted that a combination and/or mixture of loose particles comprising an expanded material and loose particles comprising metal or hard material within the same sole component may be possible.

In an embodiment, the loose particles may generally be spherical or ellipsoid in shape. A mixture of spherical and ellipsoid loose particles may also be beneficial. As the loose particles of the present invention are intended to provide haptic feedback to a user of the sole during an athletic activity, an almost direct contact between the user's foot and the loose particles may occur. Thus, using generally spherical or ellipsoidal shaped loose particles may prevent the user from discomfort, pain or even injuries while running, as sharp edges and corners are prevented. Furthermore, as the loose particles according to the present invention should be able to essentially freely move around within, for example, a cavity of the sole component, spherical or ellipsoid shapes may improve this behaviour because no sharp corners or edges of one loose particle may get caught on corners or edges of another loose particle.

In an embodiment, the loose particles may be contained within the sole component at least partly by a mesh-like material disposed on a top side of the sole component. In this manner, the present invention may provide an almost direct contact of loose particles with the sole of a user's foot. The almost direct contact may only be separated by the mesh like material and an optional thin layer of textile from a shoe upper in some embodiments. As it is known that the sole of the foot is highly susceptible for perceiving and transmitting immense amounts of stimuli to the human brain through for example the medial and lateral plantar nerves, an almost direct contact may provide a high degree of haptic sensation. The haptic feedback may thus also be received, even if the impact on the sole of the foot may be caused by a soft and/or elastic material. In addition, the impact on the sole of the foot may be sufficiently weak. This may help in providing the haptic feedback for improving and maintaining a good running technique without turning it into a negative experience due to an excessive stimulus.

In some embodiments the loose particles may be contained within the midsole at least partly by an outsole of the sole, in some embodiments an outsole comprising a mesh-like material on the side facing the midsole. Depending on the desired haptic feedback or the individual athlete, a volume having the complete thickness of the midsole may be filled with loose particles. Thus, the outsole may at least partly prevent the loose particles from dropping out. For some athletic shoes a high breathability may be of importance. To this end, the outsole may comprise openings greater than a size of each of the loose particles. In this case an additional mesh-like material may be arranged between the outsole and the midsole in order to avoid a loss of particles. The openings of the mesh-like material are typically smaller than the size of the loose particles.

In some embodiments the loose particles may be contained within a pouch made of a mesh-like material. To prevent the loose particles from dropping out of the sole component a mesh-like pouch may be beneficial. The mesh-like pouch may for example be used to define a volume in which loose particles can freely move. It may also be possible for a user of the shoe to have multiple pouches with various percentages of filling. Thus, different haptic sensations may be possible by using differently filled pouches. Exchanging of the pouches may be conducted by the user or at a selling or service facility of the shoe.

In some embodiments the loose particles may be contained within a pouch made from a foil material. To prevent moisture and/or dirt from entering the pouch of the loose particles, a foil completely enclosing the loose particles may be beneficial. The foil may be sufficiently thin in order not to significantly reduce the amount of haptic sensation from the loose particles for a user. In addition, the pouch may comprise a fluid. The loose particles may be suspended within the fluid to provide a good medium for the loose particles to move around whilst still exerting little resistance to the movement. In this manner, the fluid may be adapted to improve the massage effect of the loose particles.

In some embodiments the loose particles may exhibit a different response to compression forces exerted by the foot of the user during use when compared to the surrounding material of the sole component. The inventors found out that a sole of a user's foot can distinguish between an area of loose particles and area of surrounding material of the sole component. This may provide a great variety of possibilities of different haptic sensations to, for example, guide an athlete to run in a certain way or help the athlete recovering. Other haptic feedback scenarios are also possible. The loose particles according to the present invention may be arranged in multiple separate areas, in one single area or across most of the area of the sole component. Thus, the perceptible difference of the loose particles may help to improve various aspects of a running technique. The loose particles may also be adapted to provide additional support of the user's foot.

In some embodiments the loose particles may be arranged in a forefoot region of the shoe to aid the user in achieving a forefoot running strike. As already described above, it is a frequent goal for ambitious runners to master the forefoot running strike. The forefoot running strike describes a landing and rolling-off over the ball of the foot compared to the heel running strike with a landing on the heel and a rolling-off over the complete sole of the foot. If the athlete rolls-off over a forefoot, midfoot or heel region during a stride, the perceptible nature of the sole component material changes. This effect may be of use when learning the forefoot running strike. Therefore, an arrangement of loose particles in the forefoot region may be distinguishable from the surrounding sole component material, thus providing the athlete a direct haptic feedback whether he or she landed on the forefoot as desired or not.

In some embodiments the loose particles may be arranged in a heel region of the shoe to aid the user in achieving a forefoot running strike. As described above, the basis for the haptic feedback is a perceptible difference between the loose particles and the surrounding material of the sole component. However, as it may take some time to learn and get used to the forefoot running strike, especially for those who have just started to learn this technique, arranging the loose particles in the heel region may be beneficial. As already mentioned, the loose particles may be adapted to provide an increased cushioning compared to the surrounding material of the sole component. Therefore, for inexperienced forefoot strikers, an increased cushioning in this area can prevent injuries but may still indicate and feedback an undesired zone of landing on the foot.

In some embodiments the loose particles may change the effective weight of the sole during use of the sole. The term "effective weight", as used within the present invention, is to be understood as meaning "of a perceptible weight by the user", which may change during movement of the shoe based on for example centrifugal forces or a change in momentum of the loose particles. For example, if the loose particles may comprise an actual weight, which may be at least twice the weight of the surrounding sole component material having the same size, a change of momentum of the loose particles may provide a substantial haptic feedback to the user. The change of momentum of the loose particles may be perceived by the user as if an external force would be applied on the sole of the shoe. Thus, the effective weight of the sole may be used as haptic sensation to feedback an information about a running technique to the athlete wearing the shoe.

In addition, the effective weight of the sole may depend at least partially on a stride frequency of the user. As described above, a change in momentum may be perceived by the user as an external force applied to the sole of the shoe. Therefore, as a high stride frequency will result in multiple changes in momentum of the loose particles within a short period of time, the perceived external forces may occur more often and additionally may be felt stronger. Thus, the change of effective weight of the sole during athletic activity may provide a haptic sensation for the user of the shoe. The haptic sensation may help for example to enhance the used running technique.

In some embodiments the loose particles can move along a longitudinal direction of the sole. As the longitudinal direction of the sole usually aligns with the direction of foot movement during running, the change of effective weight based on the loose particles may directly depend on a stride frequency. For example, if at the beginning of a stride the foot is at its furthest distance behind the body and starts to move to a point furthest in front of the body, the loose particles would be pressed against the closest part of a containment to a heel region based on the direction of the applied acceleration. The containment may be a cavity, a rod, a tube or similar. This effective weight of the sole or in other words an inertia of the loose particles may already be perceived by the user as a haptic sensation. After swinging the leg in a forward direction, at some point the user will start to reduce the speed of the swing to initiate a landing on the ground. The loose particles however may still move in the forward direction and therefore may impact on the closest part of the containment to a forefoot region. The impact may be perceived by the user as a haptic sensation. Additional sensations may be perceived during a complete cycle of a stride. Therefore, the loose particles may feedback multiple sensations to the user, which may be used to enhance the applied running technique for example by increasing the stride frequency, reducing a stride length or others.

In some embodiments, the loose particles can move along a medial-to-lateral direction of the sole. Similar principles of the perceived effective weight and the resulting haptic sensations based on an inertia and/or impacts of the loose particles on a containment within the sole as described above regarding a longitudinal direction may also be valid for a medial-to-lateral direction. However, as the direction of movement of the loose particles is different as compared to the previous embodiment, the resulting haptic sensation may feedback different information. For example, if an athlete is used to toss or swing the foot sideways while running, which may increase the long-term risk of injuries and reduce the efficiency of the running performance, loose particles, able to move in a medial-to-lateral direction of the sole can feedback the occurrence of such undesired tossing. Further feedback information regarding to sideways movements may also be applicable by the present invention.

It may be noted that a longitudinal direction and a medial-to-lateral direction may also comprise directions diverging up to an angle of 45° from the indicated direction. Thus, a diagonal moving direction of the loose particles may also be applicable according to the present invention.

In another aspect the present invention provides a shoe, in particular running shoe, comprising a sole according to one of the above-described embodiments.

DETAILED DESCRIPTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

In the following, exemplary embodiments of the present invention are described in more detail, with reference to a sole and a shoe with haptic feedback. While specific feature combinations are described in the following with respect to the exemplary embodiments of the present invention, it is to be understood that the disclosure is not limited to such embodiments. In particular, not all features have to be present for realizing the invention, and the embodiments may be modified by combining certain features of one embodiment with at least one features of another embodiment.

Figure 1B:
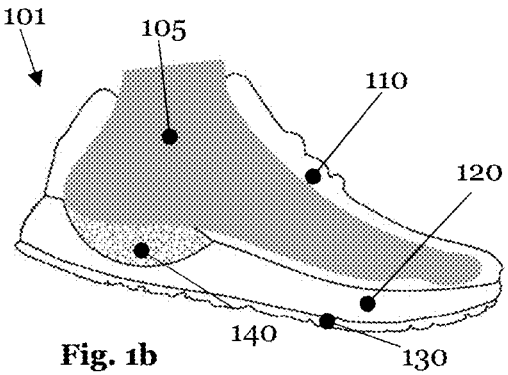
Figure 1C:
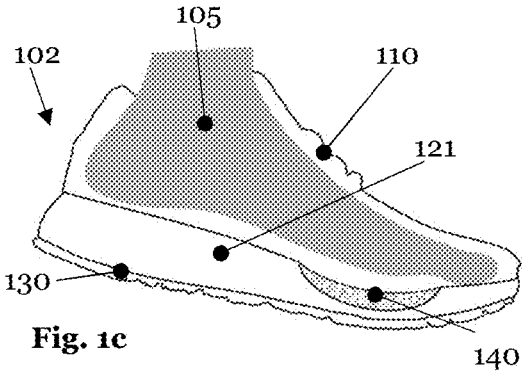
Figure 1D:
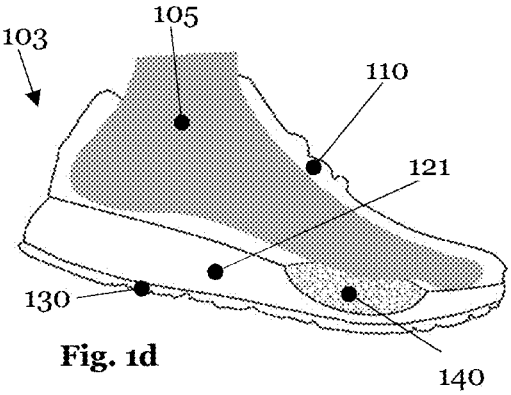

FIGS. 1*a*-1*d* depict an embodiment schematically illustrating a user's foot 105 wearing a shoe 100, 101, 102, 103 according to the present invention illustrated in a sagittal plane side view. The shoe 100, 101, 102, 103 comprises an upper 110, a midsole 120, 121 and an outsole 130. The midsole 120, 121 comprises a cavity, which is filled with various amounts of loose particles 140. The loose particles 140 may comprise expanded material, in particular expanded thermoplastic polyurethane (eTPU). In FIGS. 1*a* and 1*b*, the cavity is arranged in a heel area of the foot 105, wherein FIG. 1*a* exhibits a filling of loose particles 140 resulting in a concave shape of the cavity within the surrounding material of the midsole 120. In FIG. 1*b*, the cavity exhibits a higher amount of filling resulting in a convex shape of the cavity. FIGS. 1*c* and 1*d* illustrate a similar situation, in which the cavity is arranged in a forefoot region of the user's foot 105. FIG. 1*c* illustrates a filling resulting in a concave shape and FIG. 1*d* exhibits a higher amount of loose particle 140 filling resulting in a convex shape at the cavity. The loose particles 140 are adapted to provide a haptic feedback about a quality of a running technique to the user of the shoe 100, 101, 102, 103. Depending on various parameters of the user, such as for example skill level, bodyweight, injuries, defective position of the foot and similar, the amount of filling may be adapted to provide the intended haptic feedback for the athlete while running.

Figure 1E:
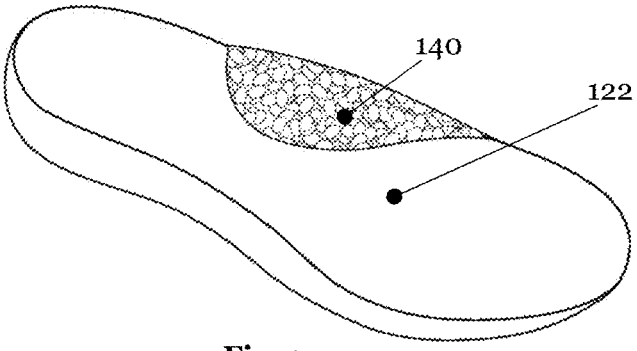

FIG. 1*e* depicts an embodiment of the present invention schematically illustrating a midsole 122 comprising a cavity filled with loose particles 140 in a midfoot region. The loose particles 140 may provide in addition to the haptic feedback an increased amount of cushioning and are able to adapt to an actual shape of the sole of the foot by an essentially free movement of the loose particles. Therefore, the present embodiment may provide an optimized form of arch support, which may be specifically adapted by the amount of filling to an individual's needs. Other regions of desired support may also be applicable according to the present invention.

Figure 2A:
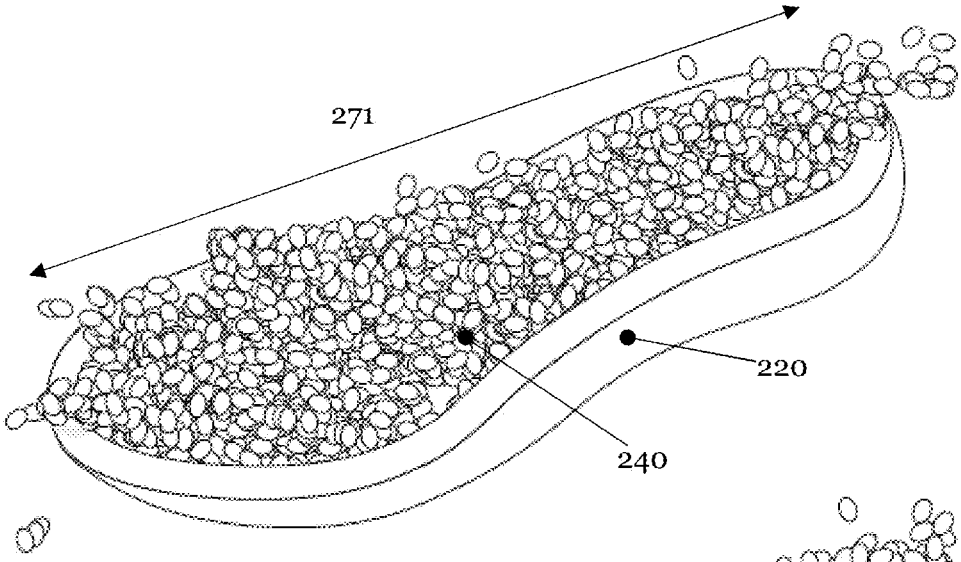
FIGS. 2*a*, 2*b*, and 2*c*: schematic illustration of embodiments of a midsole comprising loose particles.
Figure 2B:
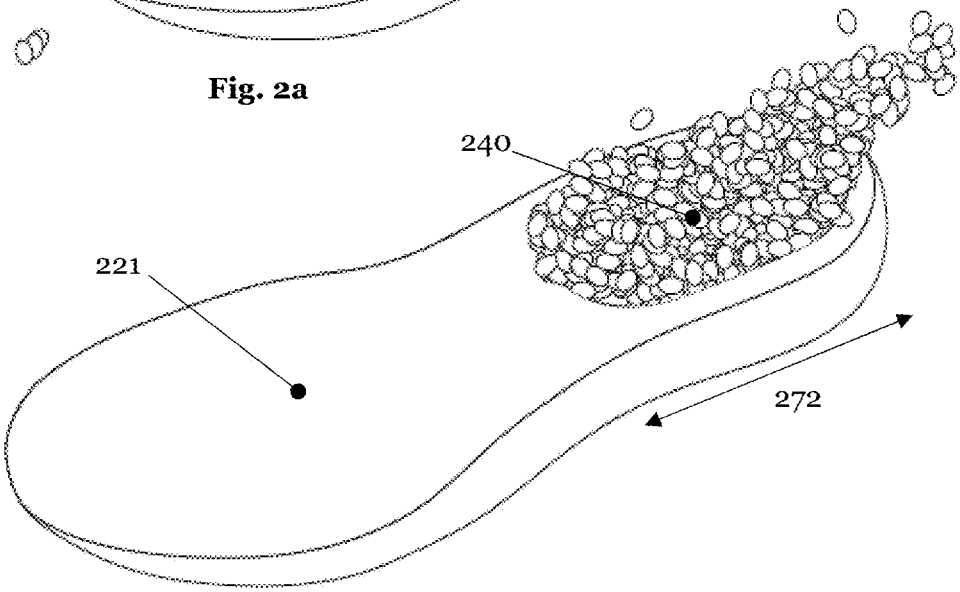
Figure 2C:
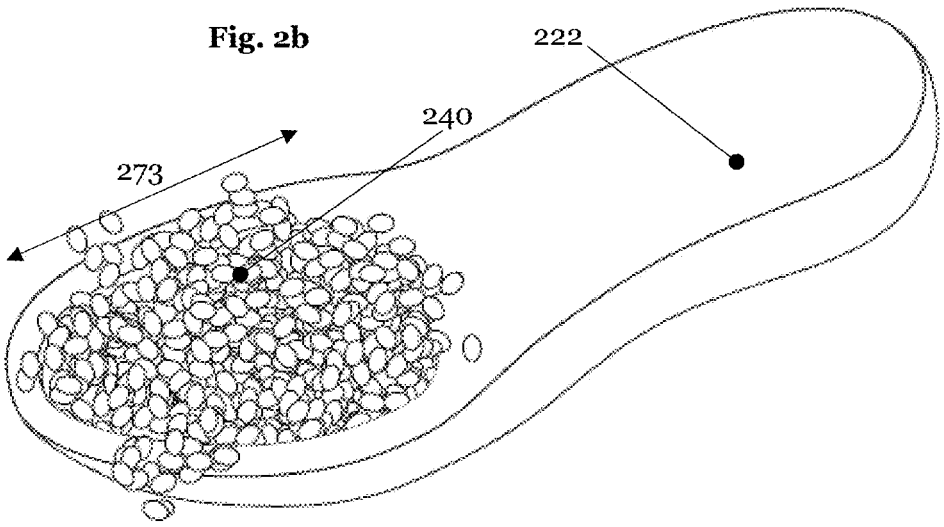

FIGS. 2*a*-2*c* depict an embodiment of the present invention, wherein the loose particles 240 are arranged across a majority 271 of the midsole 220 in FIG. 2*a*, in a heel region 272 of the midsole 221 in FIG. 2*b* or in a forefoot region 273 of the midsole 222 in FIG. 2*c*. As the sole of a user's foot is characterized through its high density of sensory receptor cells, a user can distinguish between regions of loose particles 240 and the surrounding material of the midsole 220, 221, 222, which may comprise particles of expanded material fused at their surfaces or may be at least partly manufactured by an additive manufacturing technique. Such distinguishing may be based on a different response to compression forces or loads exerted by the foot during athletic activities to the various regions of the sole, resulting in a different haptic sensation. Changing a size of a cavity filled with loose particles 240 may thus result into different haptic stimuli. If the cavity of loose particles 240 spans across the majority 271 of the midsole 220 as depicted in FIG. 2*a*, the user may experience one haptic sensation. If the cavity is smaller as in FIG. 2*b* or 2*c*, the user can distinguish between the loose particles 240 and the surrounding material. The smaller the size of the cavity the clearer the user can locate the cavity. This may be used for guiding a user to run in a certain way solely by the fed back haptic sensations while running without the need of electronic devices such as for example electronic sensors, remote displays, camera systems or others.

The arrangement of loose particles 240 in a heel region 272 as depicted in FIG. 2*b* may provide a user with increased cushioning when landing on the heel while running. The degree of cushioning may be individually adjusted by varying the amount of filling of the cavity. In addition, as the user can distinguish between a landing in the heel region 272 or in the forefoot region 273 based on the different haptic feedback perceived from the sole, the present embodiment may support in learning a desired running technique such as a forefoot running strike.

As a more advanced athlete may be able to adapt his or her technique faster than an athlete relatively new to sports, an arrangement of loose particles 240 in a forefoot region 273 as depicted in FIG. 2*c* may be beneficial. Similar as described with respect to FIG. 2*b*, the athlete may be able to distinguish between a landing in both regions 272, 273 based on the different haptic feedback of each region. However, as the loose particles 240 may be adapted to provide a higher degree of cushioning, arranging the loose particles 240 in that region in which most of the landings of the foot are expected, may result in less injuries.

Figure 3A:
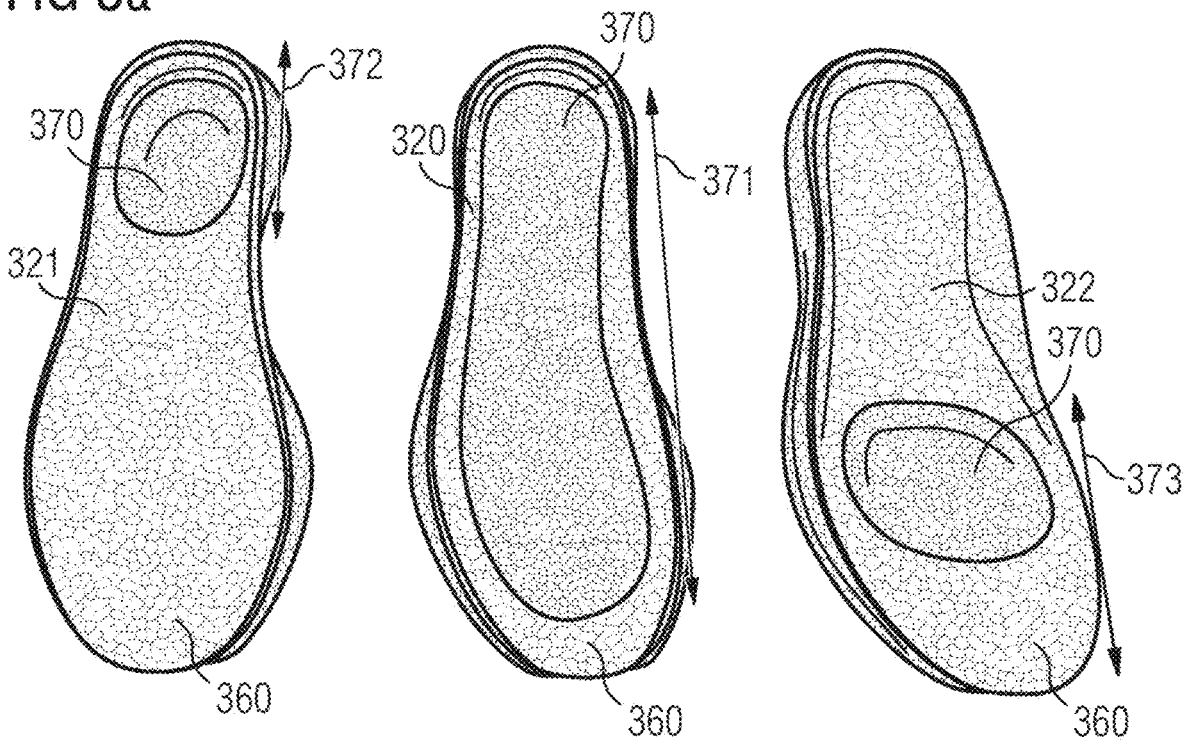
FIGS. 3*a* and 3*b*: schematic illustration of embodiments of a midsole comprising fused particles and loose particles.

FIG. 3*a* depicts three midsoles 320, 321, 322 comprising a cavity 370 in a heel region 372, across a majority 371 of the area of the midsole 320 and in the forefoot region 373. The cavity 370 comprises a depth smaller than the thickness of the midsole 320, 321, 322. Therefore, an additional mesh-like structure or foil to contain the loose particles at the bottom side of the midsole 320, 321, 322 may be omitted. The midsole 320, 321, 322 comprises particles of expanded material 360, which are fused together at their surfaces. The fused 340 and/or loose 360 particles of expanded material may, for example, comprise at least one of the following materials: expanded ethylene-vinyl-acetate (eEVA), expanded thermoplastic urethane (eTPU), expanded polypropylene (ePP), expanded polyamide (ePA), expanded polyether block amide (ePEBA), expanded polyoxymethylene (ePOM), expanded polystyrene (ePS), expanded polyethylene (ePE), expanded polylactide (ePLA), expanded polyethylene terephthalate (ePET), expanded polybutylene terephthalate (ePBT), and expanded thermoplastic olefin (eTPO). In this manner, the particles of expanded material may provide a high degree of cushioning, thermal insulation, light weight and other characteristics as already known in the art about expanded materials, as for example known about expanded TPU.

Figure 3B:
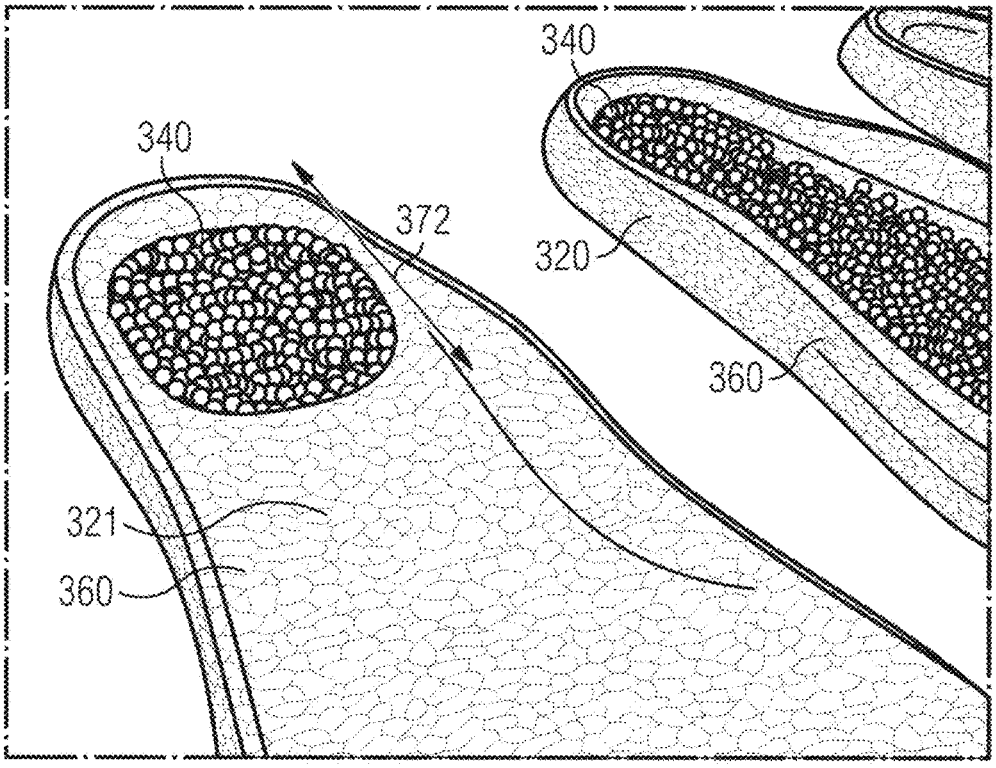

FIG. 3*b* depicts parts of the midsoles 320, 321, wherein the cavities are exemplarily filled with loose particles 340. The loose particles 340 may comprise the same expanded material as the particles 360, which are fused at their surfaces, or at least one different expanded materials. Despite only one material possibly being used for the midsoles 320, 321 of the present embodiments, a user's foot can distinguish between regions of fused eTPU 360 and regions of loose eTPU 340 based on a different haptic sensation when applying loads onto the respective area. Therefore, when for example landing on the heel region 372 and rolling-off across the entire sole of the shoe, the user can locate the different zones across the midsole 320, 321, 322. This difference may be used to improve a desired running technique or reduce the percentage of an undesired area of landing while running according to the present invention.

Figure 4A:
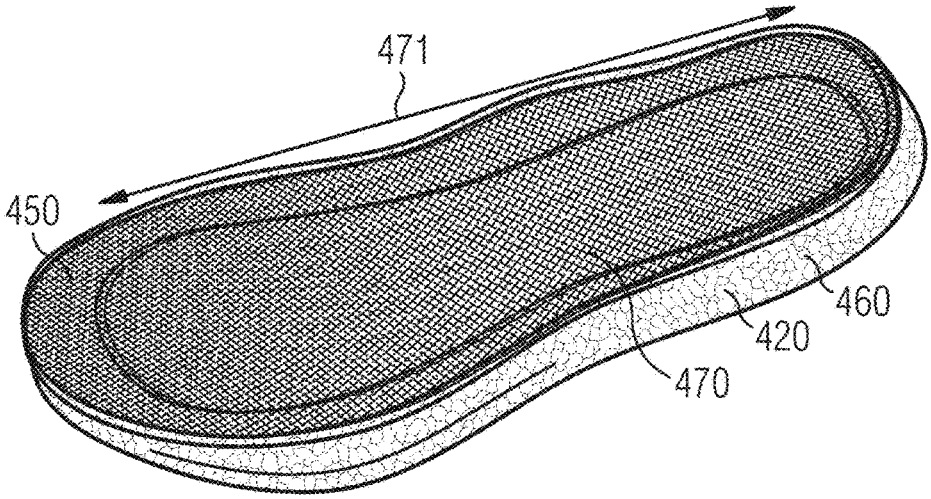
FIGS. 4*a*, 4*b*, and 4*c*: schematic illustration of embodiments of a midsole comprising fused particles and a mesh-like material on a top side.
Figure 4B:
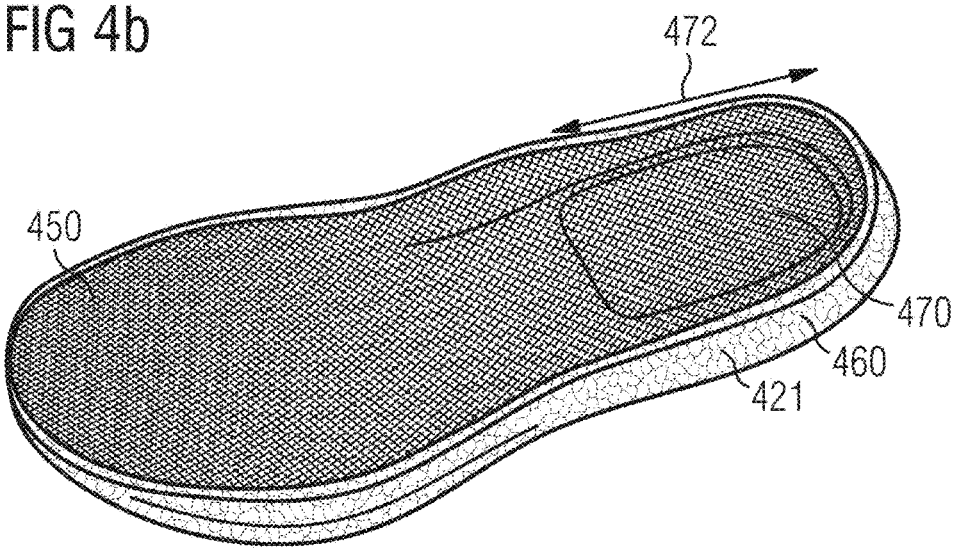
Figure 4C:
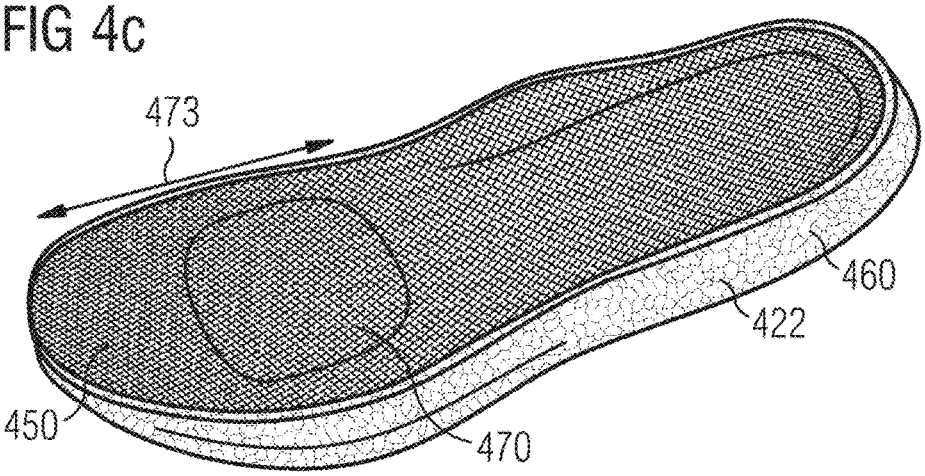

FIGS. 4*a*-4*c* depict three midsoles 420, 421, 422 comprising particles of expanded material 460, which are fused at their surfaces. The midsoles 420, 421, 422 further comprise cavities 470 similar to FIG. 3*a*. The cavities 470 are arranged across the majority 471 of the midsole 420 in FIG. 4*a*, in the heel region 472 in FIG. 4*b* and in the forefoot region 473 of the midsole 422 in FIG. 4*c*, respectively. To prevent the loose particles from dropping out of the cavity 470 while running, a mesh-like material 450 is attached to the top side of the midsoles 420, 421, 422, which is the side adapted to receive a user's foot. The mesh-like material 450 comprises a mesh with openings smaller than the size of the loose particles. Further, the material of the mesh may comprise plastic, metal, rubber or similar. In another embodiment, the mesh-like material 450 may be a foil. The foil may comprise openings smaller than the size of the loose particles or may have no openings. The foil may further be waterproof and/or breathable, to enhance a user's comfort during athletic activities. The mesh-like material 450 may further be adapted to essentially not reduce the haptic sensation perceived by the user. Thus, the mesh-like material 450 may be thin enough so that the user still receives the haptic feedback from the loose particles. The mesh-like material 450 may further be soft enough so that the user can distinguish between regions with loose particles and the surrounding midsole material.

Figure 5A:
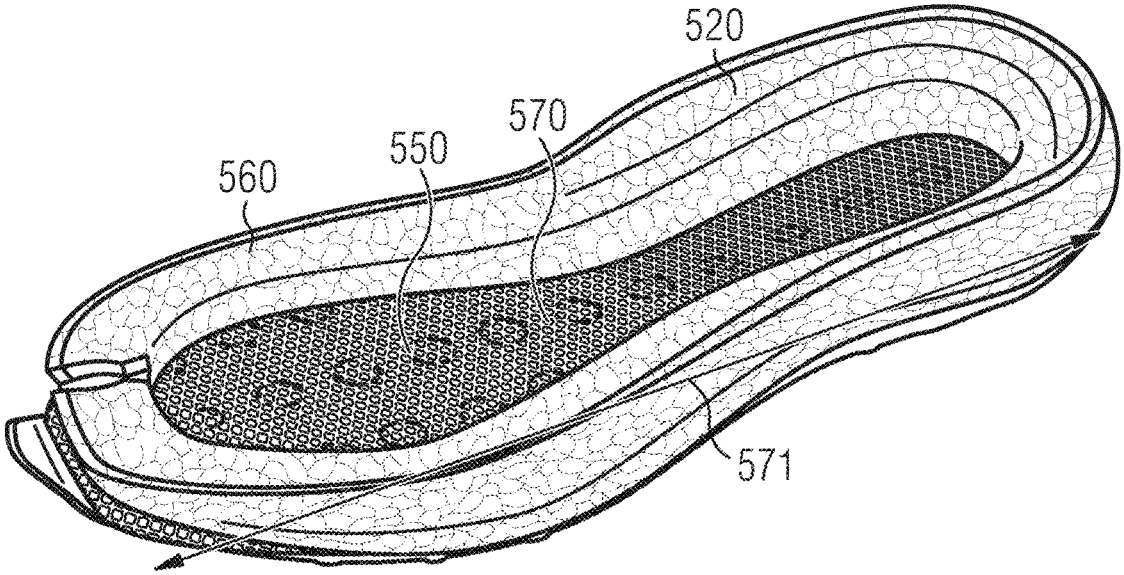
FIGS. 5*a*, 5*b*, and 5*c*: schematic illustration of embodiments of a shoe, an outsole and a midsole comprising a cavity across a majority of the midsole area.
Figure 5B:
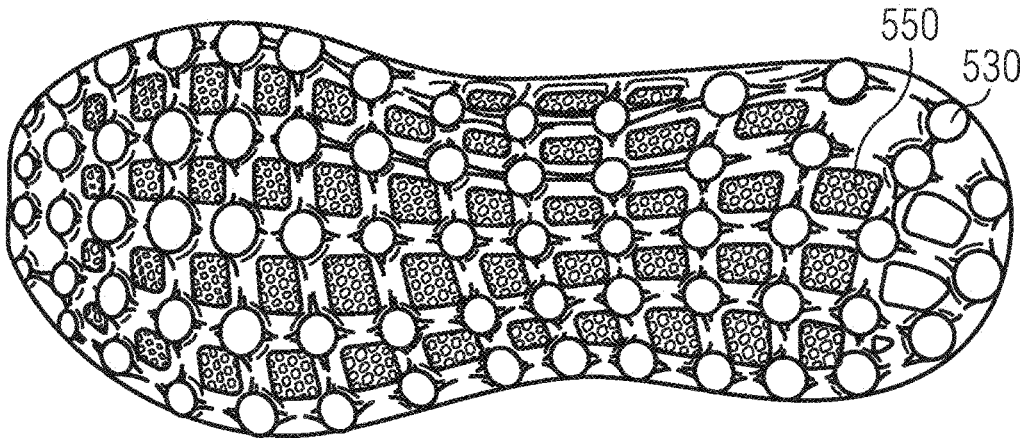
Figure 5C:
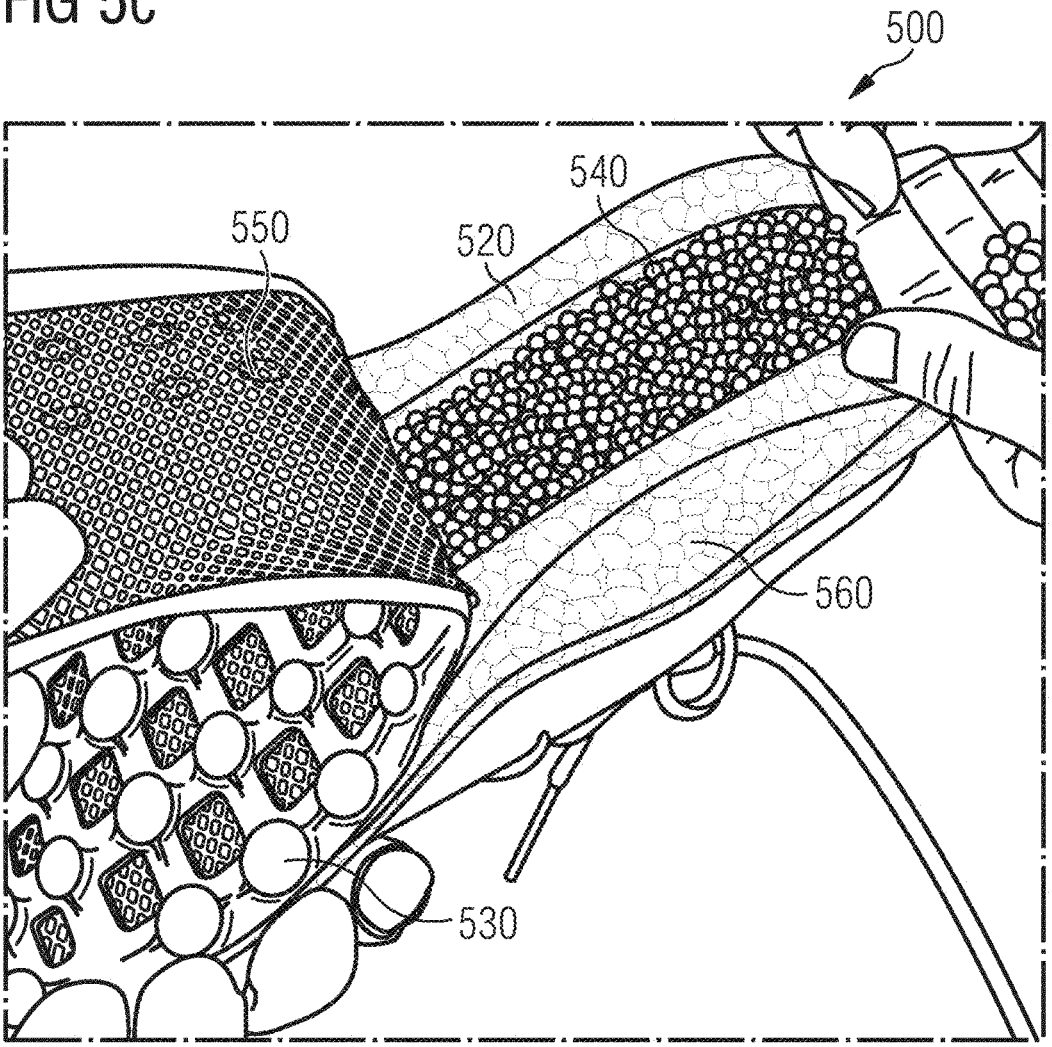

FIGS. 5*a*-5*c* depict an embodiment of a shoe 500 and a midsole 520 comprising loose particles 540 for haptic feedback according to the present invention. The loose particles 540 comprise expanded material and are arranged in a majority 571 of the area of the midsole 520. FIG. 5*a* depicts an embodiment of the midsole 520 comprising particles of expanded material 560, which are fused at their surfaces. The midsole 520 comprises a cavity 570 adapted to be filled with loose particles 540. A depth of the cavity 570 is essentially identical to the thickness of the midsole 520. In this manner, the midsole 520 only provides a containment for the loose particles 540 at the sides of the cavity 570. Thus, to prevent the loose particles 540 from dropping out of the midsole 520 while wearing the shoe 500, a mesh-like material 550 is attached to the midsole 520 from the bottom side. In other words, the mesh-like material 550 is arranged in between the midsole 520 and an outsole 530 of the shoe 500, as depicted in FIGS. 5*b* and 5*c*. The mesh-like material 550 may comprise similar characteristics as described with reference to the mesh-like material 450 of FIG. 4. The mesh-like material 550 may be a mesh or a foil. The outsole 530 may comprise rubber, thermoplastic polyurethane (TPU), polyvinyl chloride (PVC) or similar materials mentioned above, which may be adapted to provide the shoe 500 with a high traction and a durable outsole 503. The outsole 530 comprises openings greater than the size of the loose particles 540. Such openings may provide the shoe 500 with a high breathability, especially useful during athletic activities.

FIG. 5*c* depicts the embodiment of the shoe 500, wherein loose particles 540 comprising expanded material are arranged within the cavity 570 of the midsole 520. The outsole 530 and the mesh-like material 550 are partially pressed against the remainder of the shoe 500, to indicate its location in some embodiments. The outsole 530 and the mesh-like material 550 may be attached to the midsole 520 using an adhesive. In another embodiment, various components may be attached to each other without using an adhesive, for example by applying energy, for example by heat. As an example, infrared (IR) heating, radio-frequency (RF) heating or other techniques may be applied for bonding of various components comprising a thermoplastic material. In this manner, the bottom side of the midsole 520 and the top side of the outsole 530 comprising the mesh-like material 550 may be heated so that at least one of the surfaces may develop an adhesive property, sufficient to hold the individual parts of the sole together. The shoe 500 may further comprise a second mesh-like material on a top side of the midsole 520 (not shown in FIG. 5), which may be adapted to receive a user's foot. In this manner, the loose particles 540 may be completely contained within the cavity 570 of the midsole 520 and a top and bottom mesh-like material 550 preventing a dropping out of the sole while still providing a haptic feedback of the loose particles 540 for the user.

Figure 6A:
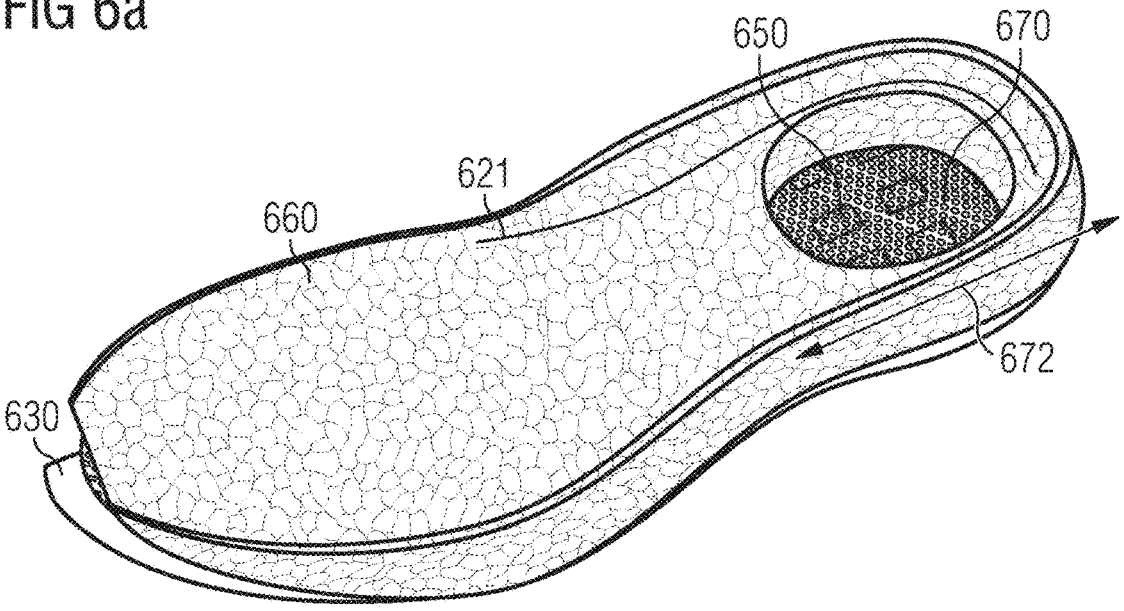
FIGS. 6*a*, 6*b*, 6*c*, and 6*d*: schematic illustration of embodiments of a shoe, an outsole and a midsole comprising a cavity in a heel area of the midsole.
Figure 6B:
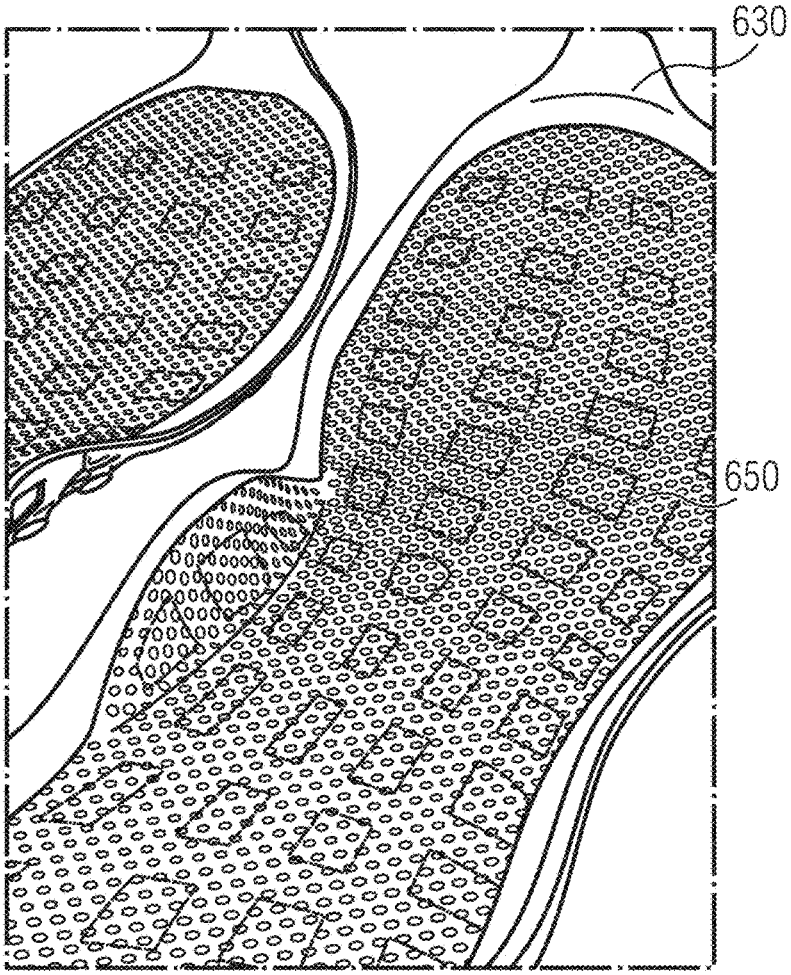
Figure 6C:
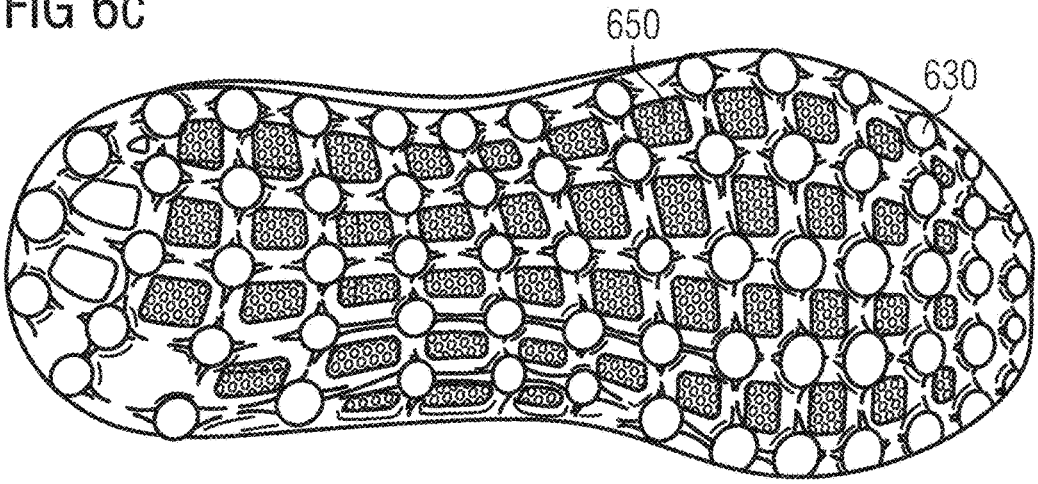
Figure 6D:
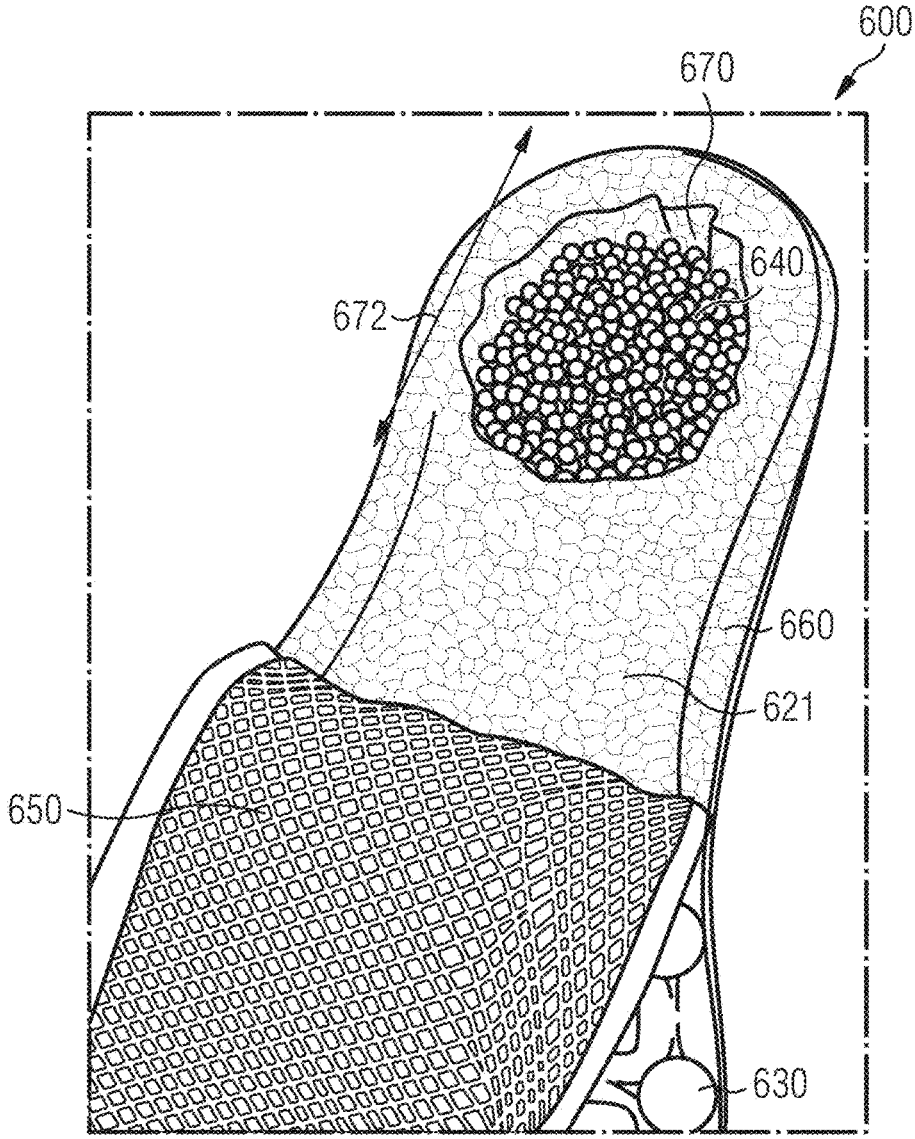

FIGS. 6*a-d* depicts another embodiment of a shoe 600 and a midsole 621 comprising loose particles 640 for haptic feedback according to the present invention. The characteristics of the outsole 630 and the mesh-like material 650 in FIGS. 6*b* and 6*c* are as described with reference to the outsole 530 and the mesh-like material 550 of FIG. 5. However, as depicted in FIG. 6*a*, a cavity 670 of the midsole 621 adapted to be filled with loose particles 640 is arranged in a heel region 672 of the shoe 600 providing haptic feedback for a user. The haptic feedback may aid the user in improving his or her running technique, as a landing in the heel region 672 on the loose particles 640 may be distinguished from a landing in a forefoot region with no loose particles. In addition, the loose particles 640 further may be adapted to provide an increased cushioning when compared to the surrounding material 660 of the midsole 621. In this manner, the shoe 600 may be optimized for an athlete, who, in some embodiments, runs with landing in the heel region 672. Furthermore, the shoe 600 may be especially suitable for a user interested in improving his or her running technique, for example, by learning a forefoot running strike. As a transition from landing in the heel region 672 to landing in the forefoot region while running may take up to several month to be fully adapted by the locomotor system of the user, loose particles 640 in the heel region 672 may be beneficial to cushion a very likely more frequent landing in the heel region 672 during the transition.

Figure 7A:
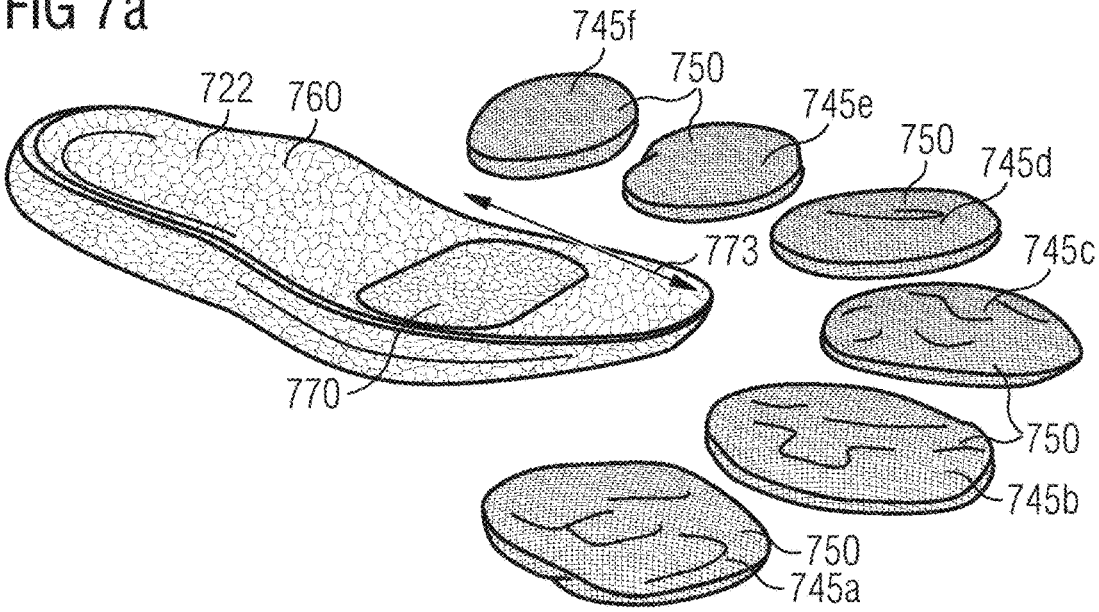
FIGS. 7*a*, 7*b*, 7*c*, 7*d*, 7*e*, 7*f*, and 7*g*: schematic illustration of embodiments of a midsole comprising a cavity in a forefoot region and pouches with loose particles.
Figure 7B:
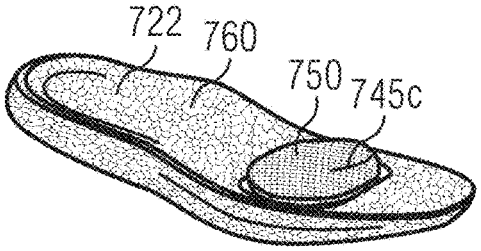
Figure 7C:
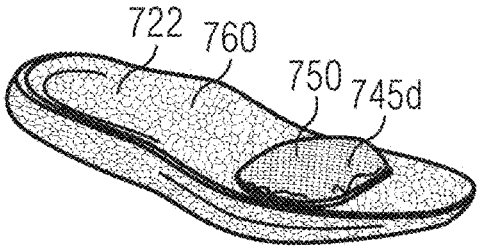
Figure 7D:
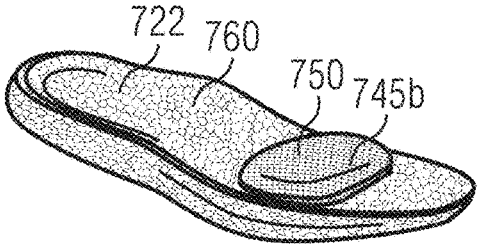
Figure 7E:
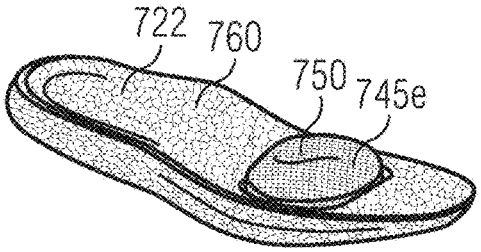
Figure 7F:
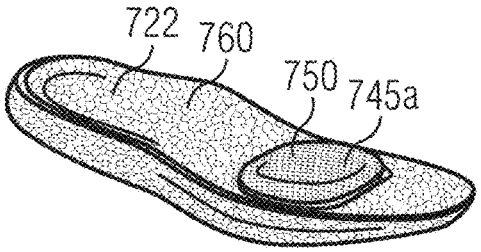
Figure 7G:
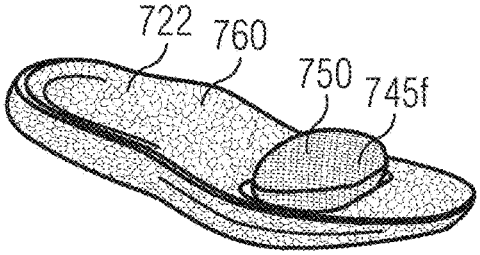

FIG. 7*a* depicts an embodiment of a midsole 722 comprising loose particles according to the present invention. The midsole 722 comprises particles of expanded material 760 fused at their surfaces and a cavity 770 arranged in a forefoot region 773 of the sole. In this embodiment the loose particles are contained within a pouch 745*a-f* comprising a mesh-like material 750. The characteristics of the mesh-like material 750 are as described with reference to the mesh-like material 450, 550, 650 of FIGS. 4, 5 and 6. Furthermore, the mesh-like material 750 may be stretchable so that the loose particles can essentially move freely within the pouch 745*a-f*. A filling of the pouches 745*a-f* with loose particles may be adaptable as depicted in FIGS. 7*a*-7*g*, wherein the filling may for example depend on a user's preference, a desired haptic stimulus, a performance level of the user and/or on a medical condition of the user. Each pouch 745*a-f* is arranged at least partially within the cavity 770 of the midsole 722 so that, depending on the filling, a range of shapes in the forefoot region 773 reaching from concave to convex may be selected. The pouches 745*a-f* may be attached to the midsole 722 using for example an adhesive, Velcro, an additional top layer adapted to fixate the pouch 745*a-f* within the cavity 570, IR heating, RF heating or similar. The pouches 745*a-f* may be exchangeable attached to the midsole 722. Thus, the user can select a preferred pouch 745*a-f* prior to wearing a shoe comprising the midsole 722 dependent for example on his or her daily preferences or an actual performance level. In another embodiment, the pouches 745*a-f* may only be exchanged at a specialist retailer or by an expert of the field.

Figure 8A:
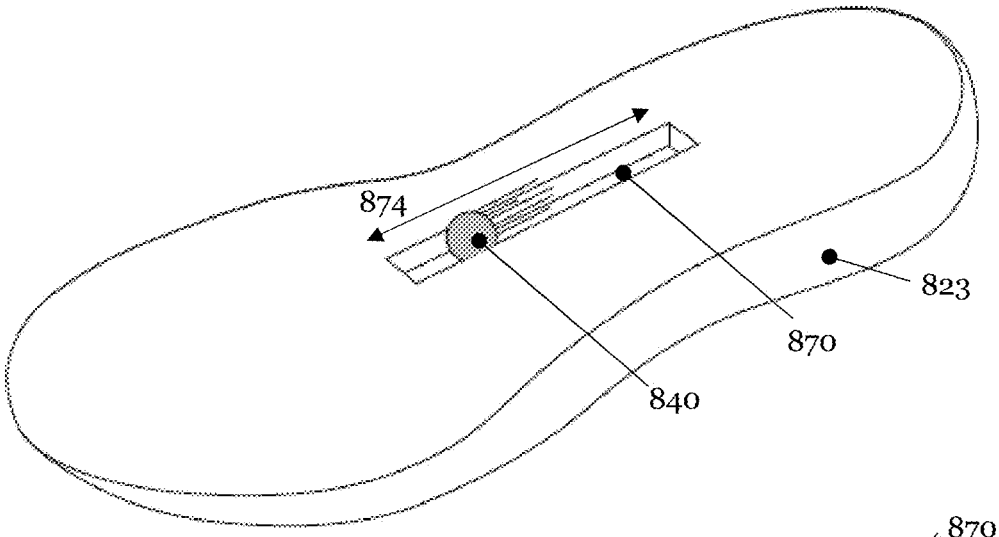
FIGS. 8*a*, 8*b*, and 8*c*: schematic illustration of embodiments of a midsole comprising loose metal particles.
Figure 8B:
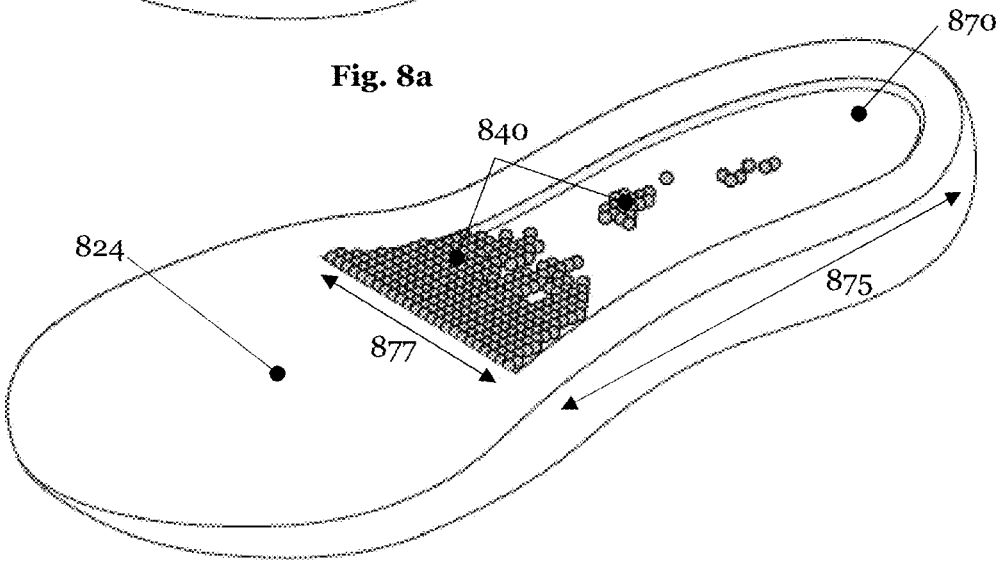
Figure 8C:
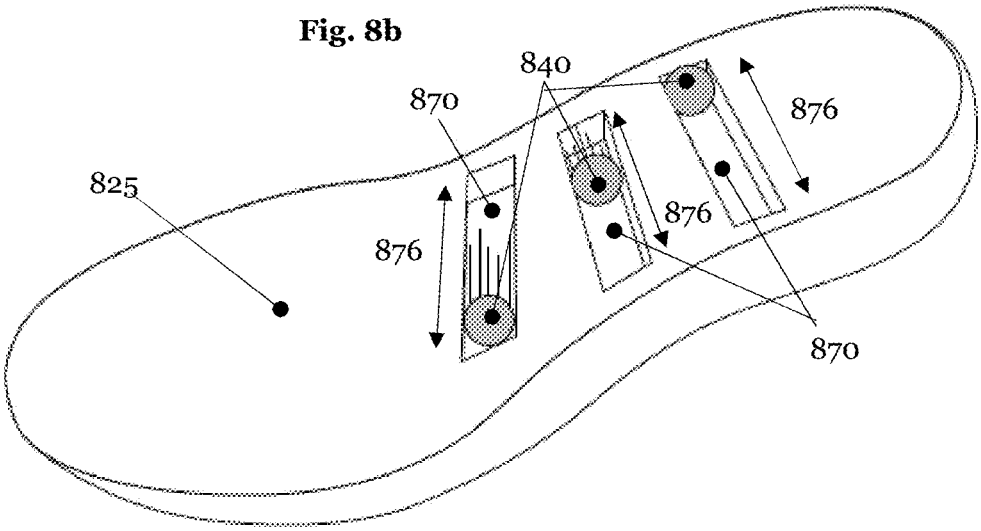

FIGS. 8*a*-8*c* depict further embodiments of midsoles 823, 824, 825 comprising at least one at least one loose particles 840 to provide haptic feedback to a user during athletic activities according to the present invention. The at least one at least one loose particles 840 may have a weight at least twice the weight of the surrounding midsole material of a same size. The at least one loose particles 840 may comprise metal or hard material. In this manner, the at least one loose particles 840 may be activated by a swing or stride of the user's leg. An inertia of the at least one loose particles 840 and/or a force applied to the midsole 823, 824, 825 based on a change of momentum of the loose particles 840 may be perceived by a user as haptic sensation. In other words, the at least one loose particles 840 can change the effective weight of the sole during use of the sole such that the user can perceive the change of effective weight as haptic sensation. The resulting haptic feedback can influence a stride frequency of the user in a positive manner, as the effective weight of the sole may depend at least partially on the stride frequency of the user.

FIG. 8*a* depicts an embodiment of the midsole 823, wherein a loose particle 840 can move along a longitudinal direction 874 of the sole. An acceleration or a deceleration, which equals to a change in momentum, of the loose particle 840 may be perceived by the user as an external force applied to the front and/or back containment of the cavity 870. Some users may report this haptic sensation as a change in effective weight of the sole or the shoe respectively. Based on the longitudinal direction 874 of movement of the loose particle 840, which is essentially parallel to a running direction, the haptic sensation may be used to feedback information about the stride frequency of the user. Additionally, as the stride frequency also depends at least partially on a length of the stride, haptic feedback about the stride length can also be perceived.

FIG. 8*c* depicts a further embodiment of a midsole 825, wherein three loose particles 840 can move along a medial-to-lateral direction of the sole. The basic principle of perceiving haptic sensations based on a change of momentum of the loose particles 840 or a change of effective weight of the sole as described with respect to FIG. 8*a* also applies here. However, as the direction of movement of the loose particles 840 predetermines the direction of movement of the user's foot about which haptic feedback may be provided, the midsole 825 depicted in FIG. 8*c* mainly supports in determining an unwanted tossing or swinging of the foot sideways 876 while running. Such behaviour may result in a higher risk of injuries and an inefficient way of running. Therefore, providing a shoe with haptic feedback about undesired sideways 876 movement of a foot while running may help a user to avoid this behaviour. Thus, the shoe comprising the midsole 825 may help a user in improving his or her running technique based on haptic feedback.

FIG. 8*b* depicts another embodiment of a midsole 824, wherein multiple loose particles 840 can move within a two-dimensional plane essentially parallel to a user's sole of the foot. The basic principle of perceiving haptic sensations based on a change of momentum of the loose particles 840 or a change of effective weight of the sole as described with respect to FIGS. 8*a* and 8*b* also applies here. However, as the loose particles 840 are adapted to move in a longitudinal direction 875 and a medial-to-lateral direction 877 simultaneously, the midsole 824 can provide haptic sensations based on a stride frequency and a swinging or tossing of a leg while running simultaneously. In addition, as the midsole 824 comprises multiple loose particles 840, the provided haptic stimuli may be perceived as multiple single haptic stimuli generated by each of the loose particles 840 blurred into a more continuous haptic sensation when compared to embodiments with only one or a few loose particles 840.

Figure 9A:
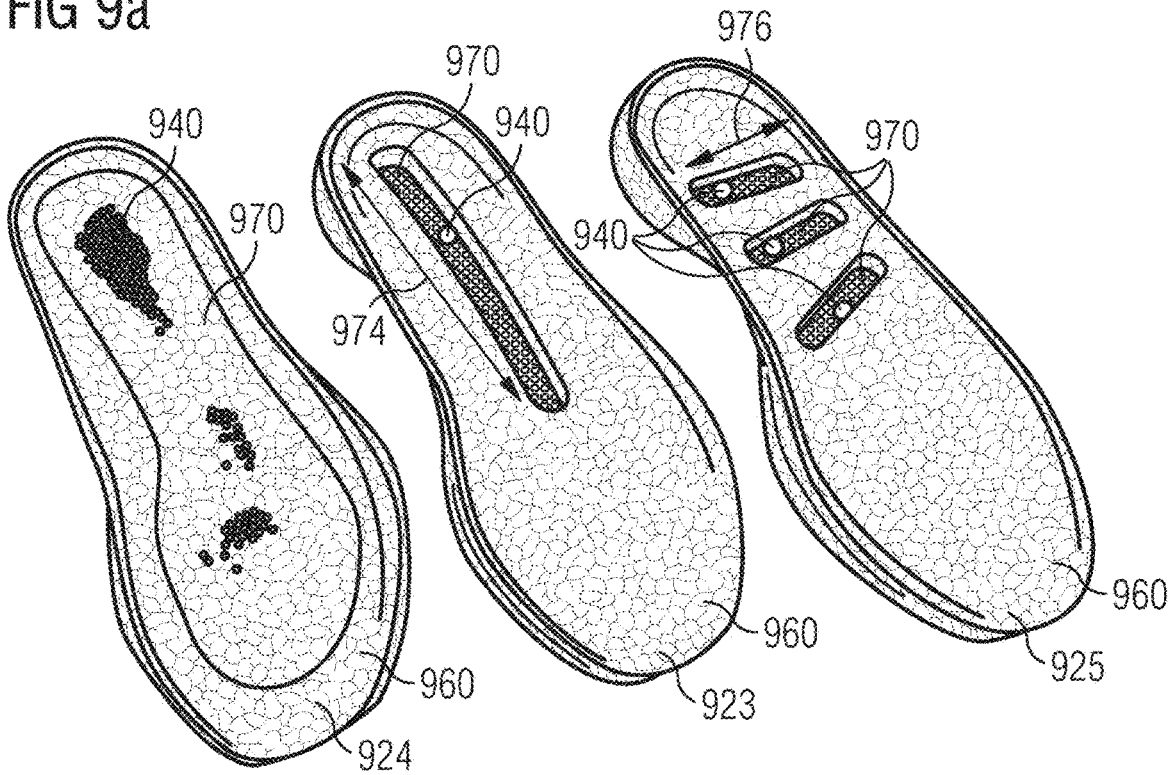
FIGS. 9*a* and 9*b*: schematic illustration of embodiments of a midsole comprising fused particles and loose metal particles.

FIG. 9*a* depicts three midsoles 923, 924, 925 comprising at least one loose particles 940 adapted to move within a two-dimensional plane essentially parallel to a user's sole of the foot, in a longitudinal direction 974 and in an essentially medial-to-lateral direction 976 of the sole. It may be noted that other directions of movement of the loose particles 940 are also applicable by the present invention. The midsoles 923, 924, 925 comprise particles of expanded material 960, which are fused at their surfaces. The at least one loose particles 940 comprise metal or hard material. Therefore, as the at least one loose particles 940 comprise a higher specific weight as the surrounding expanded material 960 of the midsoles 923, 924, 925, a user can perceive a change of momentum of the at least one loose particles 940 or a change of effective weight of the sole as haptic sensation.

Figure 9B:
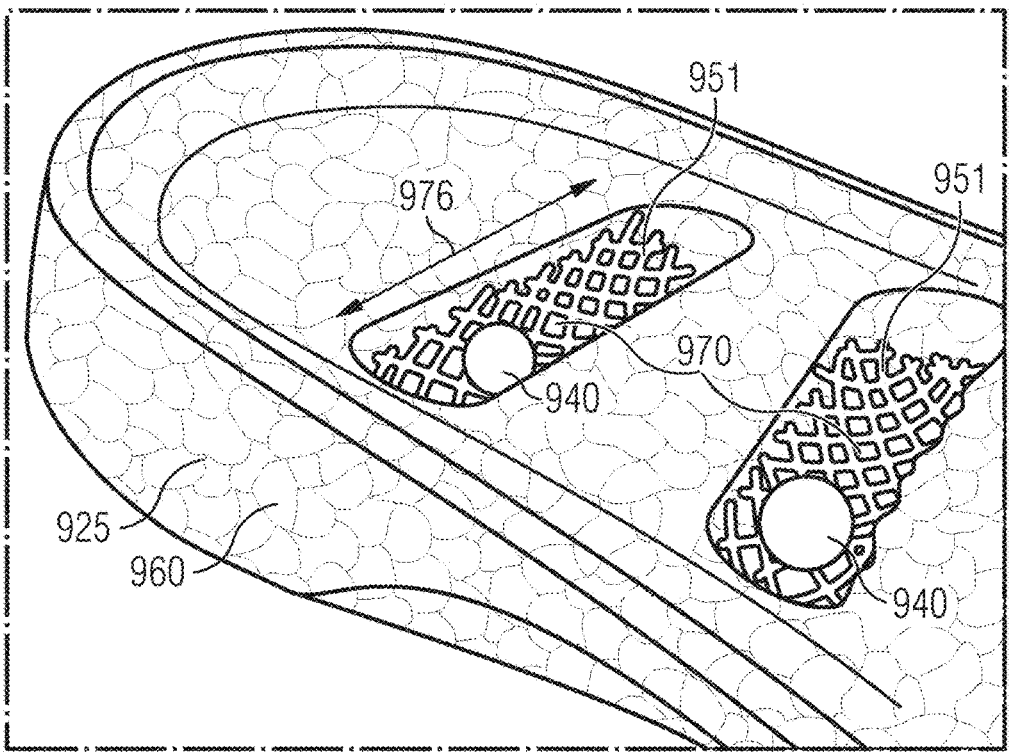

FIG. 9*b* depicts a zoomed illustration of the midsole 925, in which a mesh-like material 951 is arranged within the cavity 970 and underneath the metal loose particles 940 to provide an essentially free movement of the metal loose particles 940. The mesh-like material 951 may also be arranged in the cavities 970 of various midsoles, such as for example midsole 923 or 924.

Figure 10A:
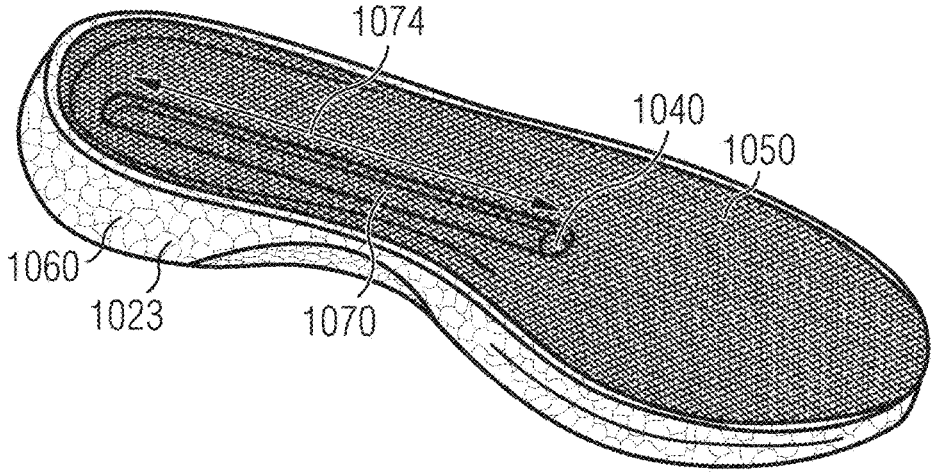
FIGS. 10*a*, 10*b*, and 10*c*: schematic illustration of embodiments of a midsole comprising fused particles, loose metal particles and a mesh-like material on a top side.
Figure 10B:
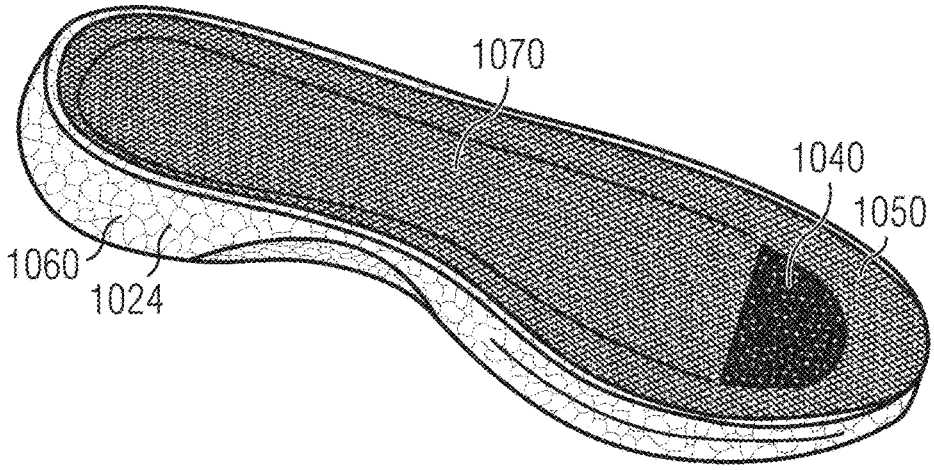
Figure 10C:
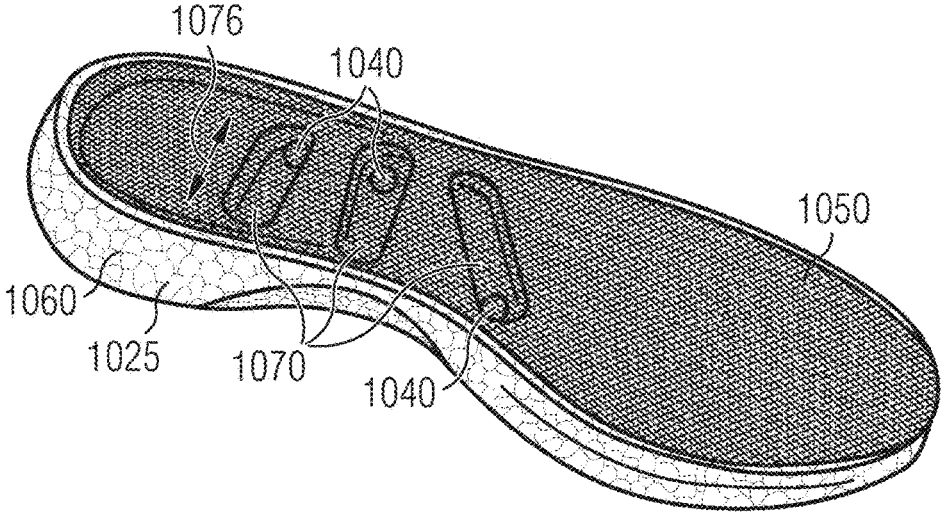

FIGS. 10*a*-10*c* depict three midsoles 1023, 1024, 1025 comprising at least one loose particles 1040 adapted to move in a longitudinal direction 1074, within a two-dimensional plane essentially parallel to a user's sole of the foot and in an essentially medial-to-lateral direction 1076 of the sole. The midsoles 1023, 1024, 1025 comprise particles of expanded material 1060, which are fused at their surfaces. To prevent the at least one loose particles 1040 from dropping out of the cavity 1070 while running, a mesh-like material 1050 is attached to the top side of the midsoles 1023, 1024, 1025, which is the side adapted to receive a user's foot. The characteristics of the mesh-like material 1050 are as described above with reference to the mesh-like material 450, 550, 650, 750 of FIGS. 4, 5, 6 and 7.

Figure 11A:
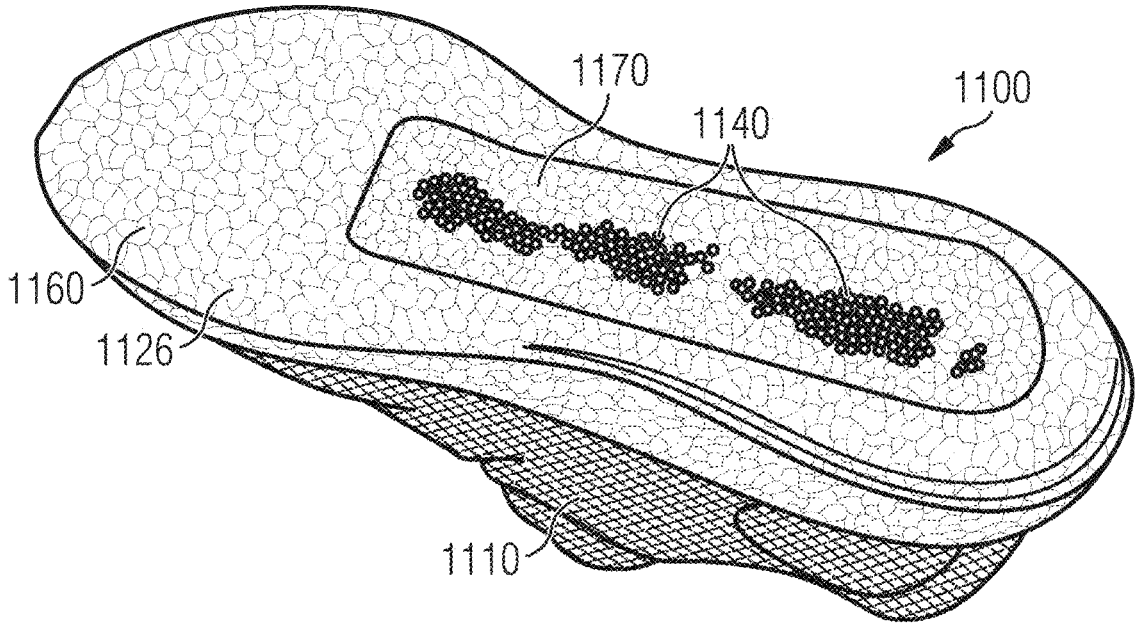
FIGS. 11*a* and 11*b*: schematic illustration of embodiments of a shoe comprising an outsole and a midsole comprising a cavity with loose metal particles.
Figure 11B:
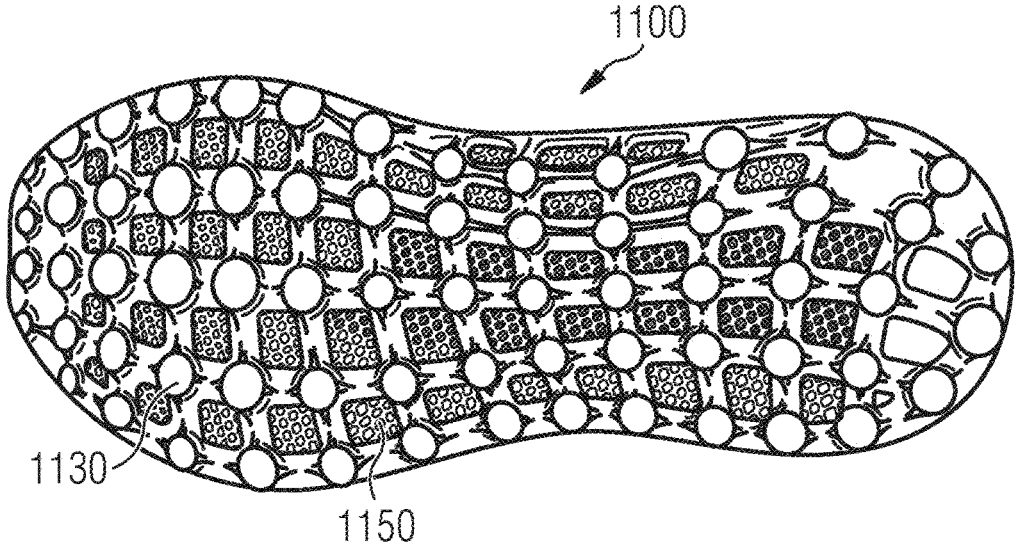

FIGS. 11*a*-11*b* depict an embodiment of a shoe 1100 and a midsole 1126 comprising loose particles 1140 adapted to move within a two-dimensional plane essentially parallel to a user's sole of the foot for providing haptic feedback according to the present invention. The loose particles 1140 comprise metal or hard material and are arranged in a cavity 1170 of the midsole 1126. The cavity 1170 is located on a bottom side of the midsole 1126, which is the side directed to the ground when standing still while wearing the shoe. The midsole 1126 comprises particles of expanded material 1160, which are fused at their surfaces. The haptic feedback provided by the metal loose particles 1140 of the present embodiment may be perceived by the user without being in direct contact with the loose particles 1140. Therefore, locating the loose particles 1140 in a cavity 1170 with a depth smaller than the thickness of the midsole 1126 may omit a mesh-like material 1150 on the topside of the midsole 1126 preventing the loose particles 1140 from dropping out. Furthermore, the cavity 1170 does not provide a continuous opening within the midsole 1126. Thus, the midsole 1126 may be waterproof and/or provide thermal insulation.

FIG. 11*b* depicts an outsole 1130 and a mesh-like material 1150 attached to the shoe 1100 in a bottom view. The characteristics of the outsole 1130 and the mesh-like material 1150 are as discussed above with respect to outsoles 530 and 630 of FIGS. 5 and 6 respectively and the mesh-like material 450, 550, 650, 750, 1050 of FIGS. 4, 5, 6, 7 and 10.

Figure 12A:
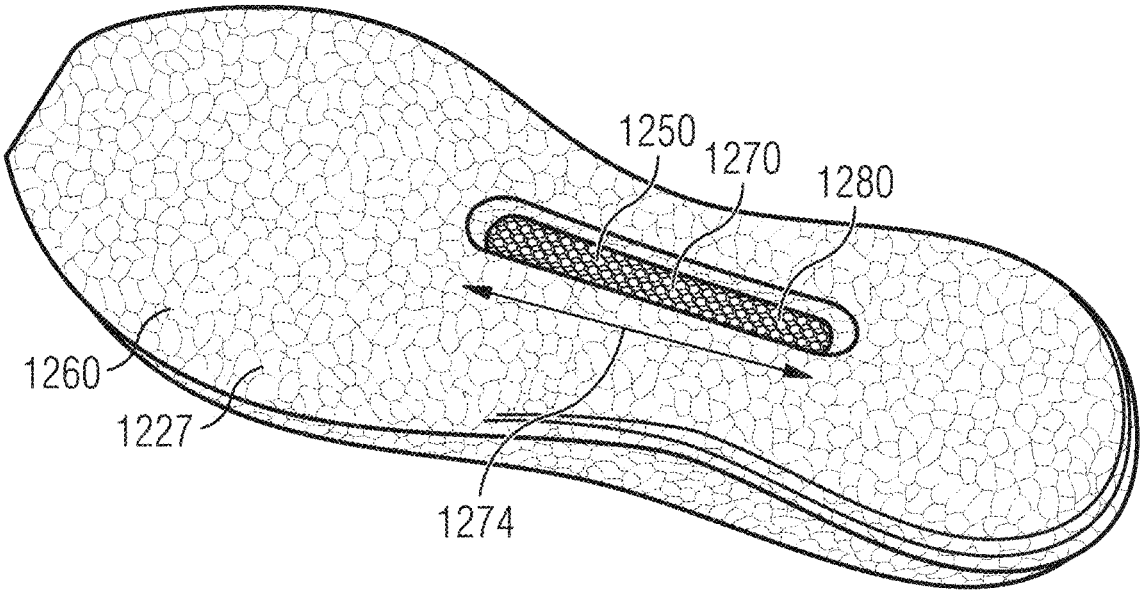
FIGS. 12*a* and 12*b*: schematic illustration of embodiments of a midsole comprising a cavity and an outsole attached to the midsole.
Figure 12B:
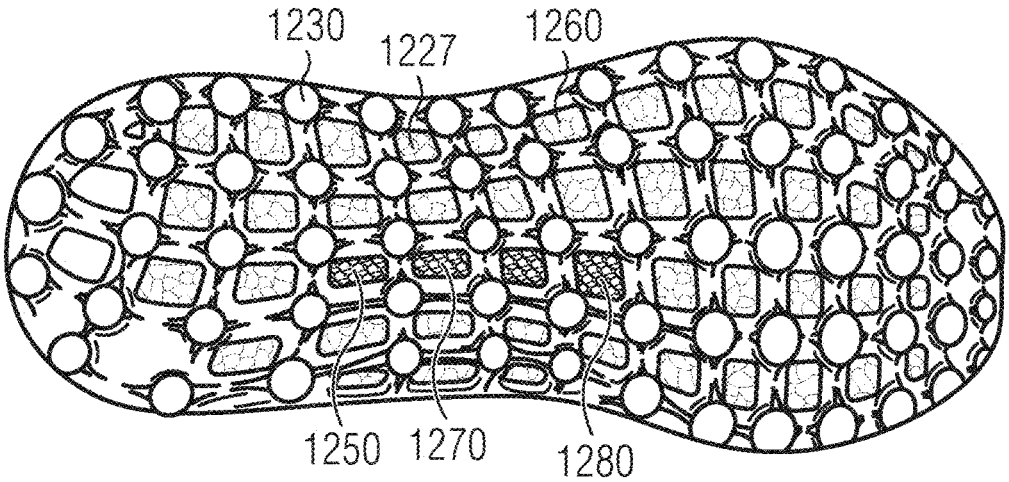

FIG. 12*a* depicts an embodiment of a midsole 1227 comprising particles of expanded material 1260 fused at their surfaces. Midsole 1227 further comprises a cavity 1270 adapted to receive at least one loose particles for providing haptic feedback according to the present invention. The cavity 1270 is arranged in a longitudinal direction 1274 of the sole, thus predefining a direction of movement of the at least one loose particles. The at least one loose particles may comprise metal. In this manner, the longitudinal movement of the at least one loose particles may result in a haptic sensation influencing for example a stride frequency of the user positively. The at least one loose particles of FIG. 12*a* are arranged within a tube 1280 formed out of a mesh-like material 1250. The characteristics of the mesh-like material 1250 are as discussed above with respect the mesh-like material 450, 550, 650, 750, 1050, 1150 of FIGS. 4, 5, 6, 7, 10 and 11. As the at least one loose particles are prevented from dropping out by the tube 1280 of mesh-like material 1250, an additional layer of mesh-like material 1250 between the midsole 1227 and the outsole 1230 may be omitted, as depicted in FIG. 12*b*. The tube 1280 comprising the at least one loose particles may not be changeable in the present embodiment, to ensure no undesired movement of the cavity 1270. Therefore, the cavity 1270 may be covered by the outsole 1230.

Figure 13A:
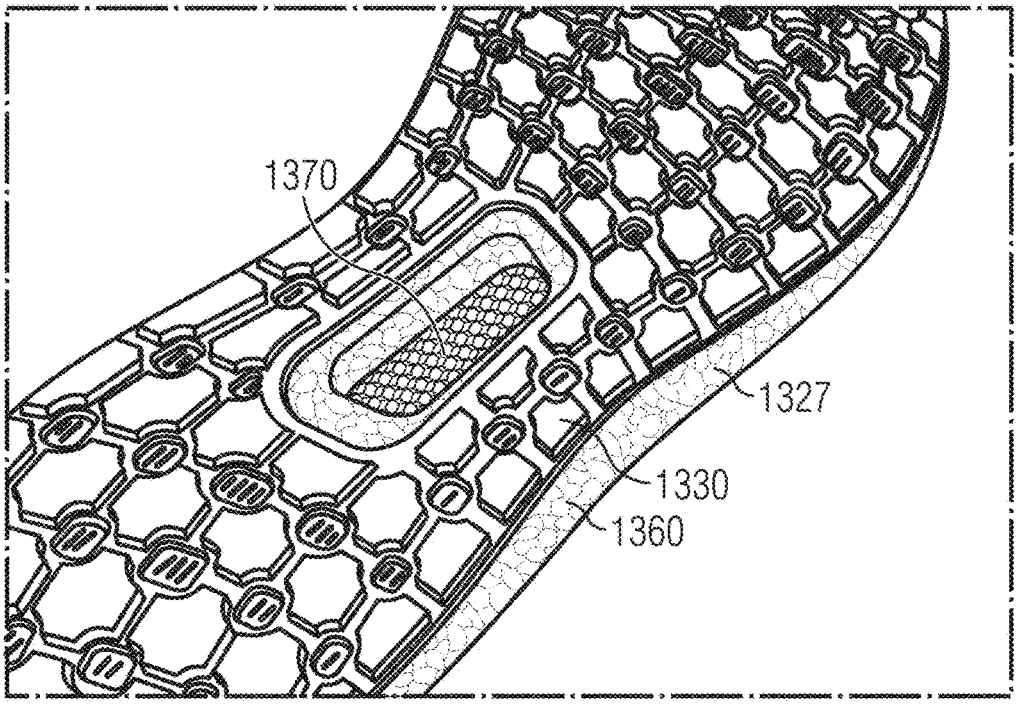
FIG. 13*a*: schematic illustration of an embodiment of a mid- and outsole assembly comprising a cavity.
Figure 13B:
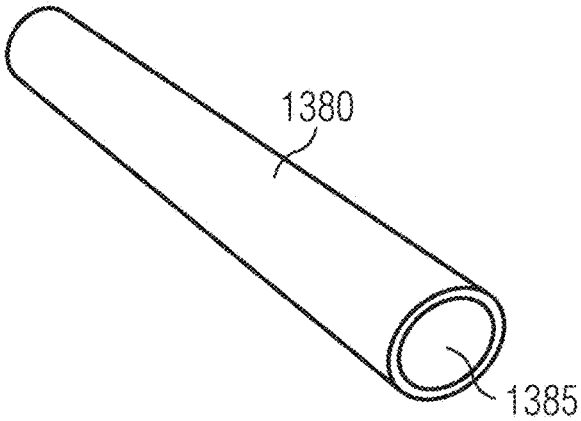
FIGS. 13*b* and 13*c*: schematic illustration of embodiments of a tube.
Figure 13C:
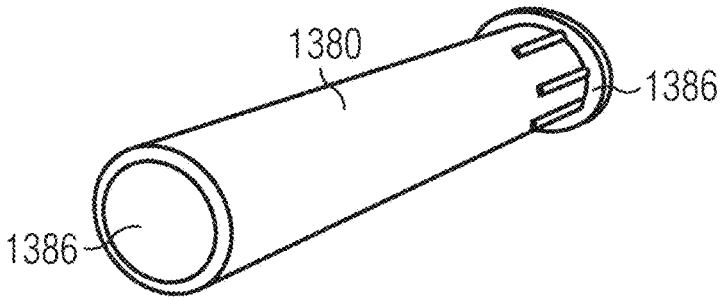

In a similar embodiment depicted in FIG. 13*a*, the at least one loose particles may be arranged within a tube or rod 1380 comprising a plastic, rubber, PVC, TPU or a similar material as depicted in FIGS. 13*b* and 13*c*. The tube or rod 1380 may be adapted to be exchangeable within the cavity 1370 of the midsole 1327, wherein the midsole 1327 comprises particles of expanded material 1360 fused at their surfaces. Thus, a user of the shoe can adapt the loose particles within the tube or rod 1380 according to his or her desired haptic stimulus. If the user for example prefers a more intense and/or direct haptic feedback, at least one loose metal particles with a higher weight as used before may be suitable. If in contrast the user prefers for example a more subtle and/or less intense haptic feedback, at least one loose metal particles with lighter weight as used before may be beneficial. The tube or rod 1380 may comprise two caps (not shown), which may be opened 1385 for exchanging the at least one loose particles as depicted in FIG. 13*b*. In an alternative embodiment, the tube or rod 1380 may be permanently sealed 1386. In this way, the user can choose between various tubes or rods 1380 comprising different properties such as for example a weight or quantity of loose particles, a dimension of the tube or rod 1380 or similar. Furthermore, the length of the tube or rod 1380 may be adjustable (not shown). In this manner, as the haptic sensation depends on the length of the tube or rod 1380, the provided haptic stimulus may be adaptable. For example, the length of the tube or rod 1380 may be adjusted to result in a haptic feedback positively influencing the user to run with a desired stride frequency. In addition, the length of the tube or rod 1380 may be adapted to a body dimension of the user such as for example a height, a preferred stride length or similar.

It may be noted that an exchangeable tube or rod 1380 may also be applicable in a cavity arranged in a medial-to-lateral direction or any other direction. Furthermore, an embodiment comprising a cavity arranged in a longitudinal direction and a cavity arranged in medial-to-lateral direction may also be possible. In this manner, a user can decide for which movement haptic feedback is desired and attach a tube or rod 1380 comprising loose particles to the respective cavity 1370 accordingly. The user may also attach two tubes or rods 1380 at the same time, each arranged in one of the cavities 1370 for receiving haptic feedback for both movement directions simultaneously. The number of cavities and tubes of a midsole may not be limited to the above examples.

Figure 14A:
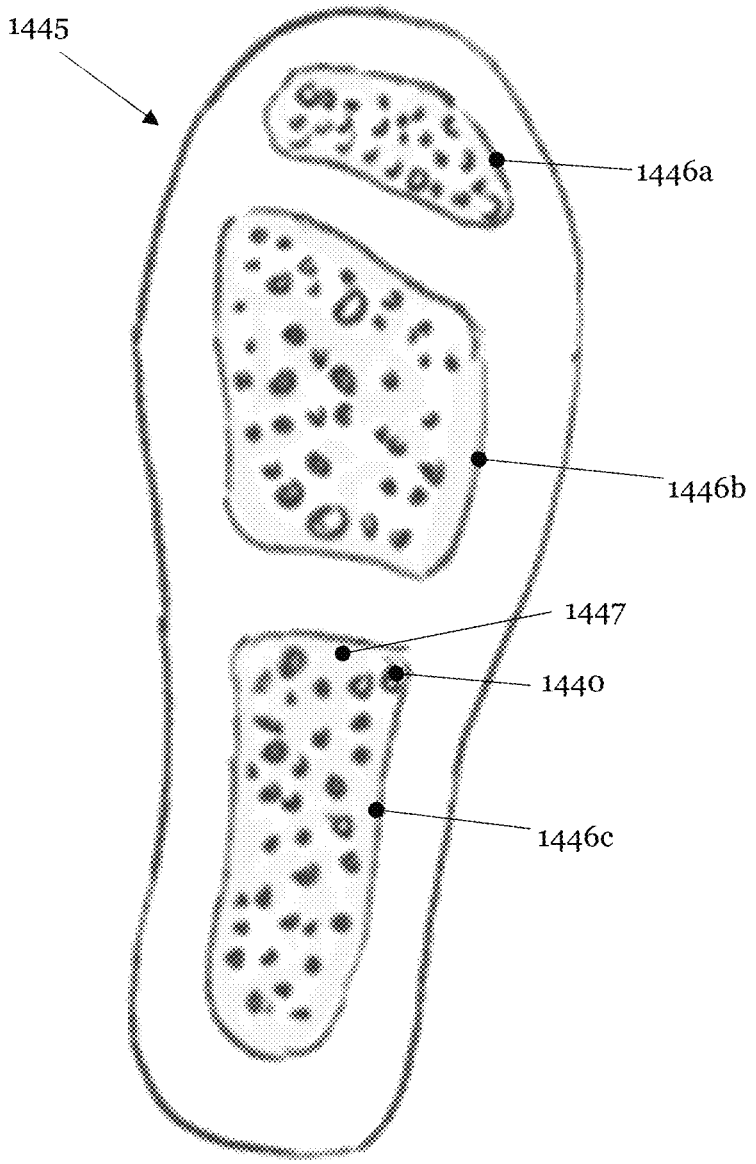
FIG. 14*a*: schematic illustration of an embodiment of a fluid filled pouch comprising loose particles.
Figure 14B:
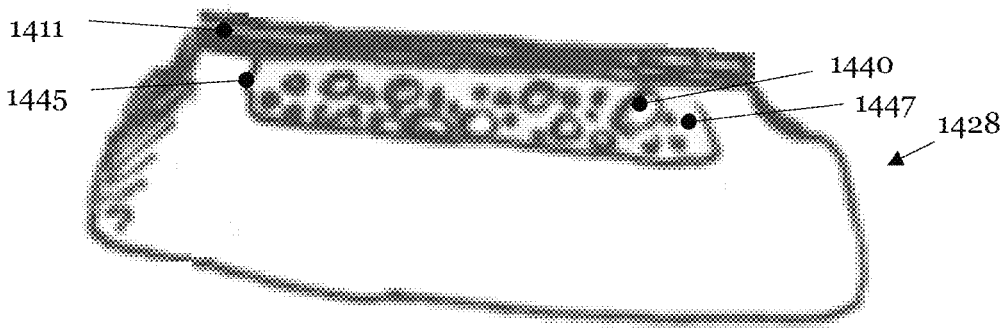
FIG. 14*b*: schematic illustration of a profile of a midsole comprising loose particles suspended in a fluid.

FIG. 14*a* depicts an embodiment of a fluid filled pouch 1445 comprising loose particles 1440 in accordance with the present invention. The loose particles 1440 are contained within the pouch 1445 and may be suspended in a fluid 1447. Alternatively or in addition to the haptic feedback discussed above with reference to the loose particles 140, 240, 340, 540, 640, 840, 940, 1040, 1140 described with reference to FIGS. 1-13, loose particles 1440 may further be adapted to provide a haptic feedback in form of a pleasant massage effect for a user's foot. The loose particles 1440 may comprise various hardness, materials and/or sizes depending on the desired intensity of the massage, which may be adapted to different areas of a user's foot. Moreover, the fluid 1447 may comprise a gel, a liquid, or an oil. The fluid 1447 may be adapted to provide a medium for the loose particles 1440 to essentially move freely whilst providing some degree of resistance. By choosing a certain fluid, gel, liquid or oil, the degree of resistance may be adaptable to provide the desired intensity of the massage effect. In another embodiment, gas, in particular air, may be used instead of the fluid 1447. The loose particles 1440 may be adapted to redistribute within the pouch 1445 with each step, resulting in constantly varying pressure points applied to the muscles and other tissues of a user's foot. The redistribution of the loose particles 1440 with each step may most closely simulate an active human massage. The various areas of the pouch 1445, specifically optimized based on the anatomy of the foot portion contacting this area, may be divided into a forefoot area 1446*a*, midfoot area 1446*b* and rearfoot area 1446*c*, as depicted in FIG. 14*a*. Other segmentations or more/fewer separate areas are also possible. To provide an essentially direct contact of loose particles to the sole of a user's foot, the pouch 1445 or differently contained areas may be arranged in a top section of a midsole 1428, as depicted in FIG. 14*b*. The midsole 1428 may be covered by an optional soft insole layer 1411 or a soft bottom part of an upper of the shoe. The midsole 1428 may further comprise a rocker geometry, i.e. a slightly curved shape of the midsole sloping towards the centre of the foot bed. The massage effect of the loose particles 1440 may be accentuated by the rounded shape of the rocker geometry of the midsole 1428 helping to press the loose particles 1440 into the tissue of the user with each step. Moreover, the rocker geometry may further enable the user to roll his/her foot back and forth whilst seated, which may help to improve a posture of the user of such a shoe by stimulating e.g. the lower back muscles.

Figure 15:
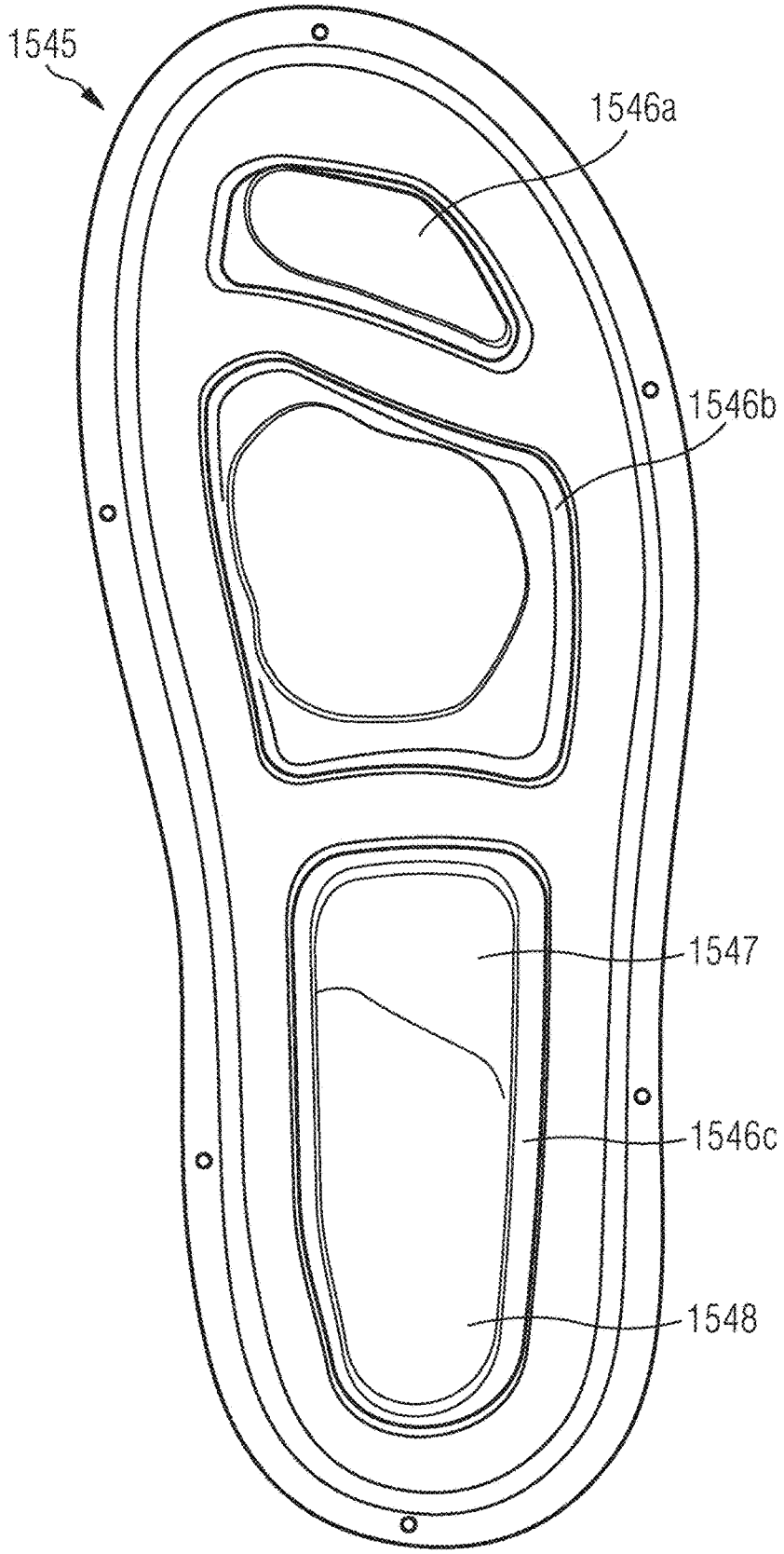
FIG. 15: schematic illustration of an embodiment of a fluid filled pouch.

FIG. 15 depicts an embodiment of a fluid filled pouch 1545 comprising three separate areas 1546*a-c* as similarly described with reference to FIG. 14*a*. Each of the separate areas 1546*a-c* may be filled with loose particles to provide a massage effect in accordance with the present invention (not shown in FIG. 15). The loose particles may be suspended in a fluid 1547 or a gas 1548. Also, a mixture of fluid 1547 and gas 1548 e.g. an area 1546*a-c* of a pouch 1545 partially filled with the fluid 1547, may be possible. The pouch 1545 may for example comprise two layers of TPU, attached to each other via heat bonding, such as IR or RF heating, by using an adhesive or a similar technique. Various other materials which allow for a thin, soft layered and sealed pouch 1545 may also be applicable.

Figure 16A:
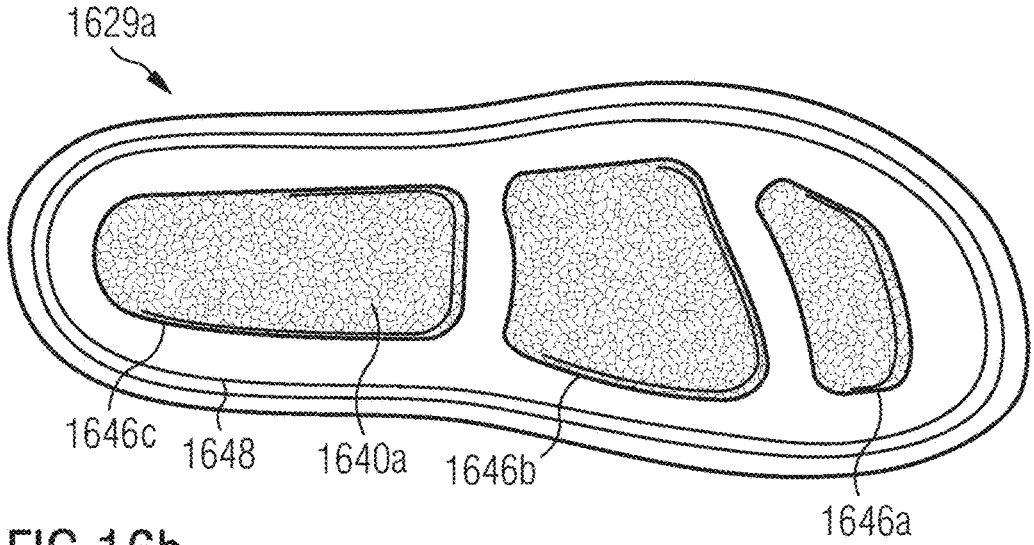
FIGS. 16*a*, 16*b*, and 16*c*: schematic illustration of embodiments of an insole comprising loose particles.
Figure 16B:
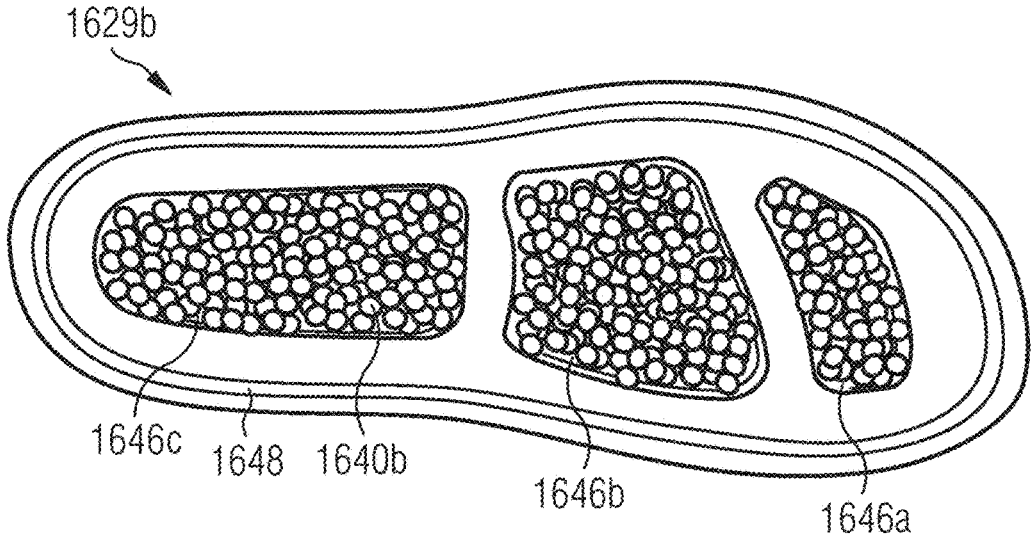
Figure 16C:
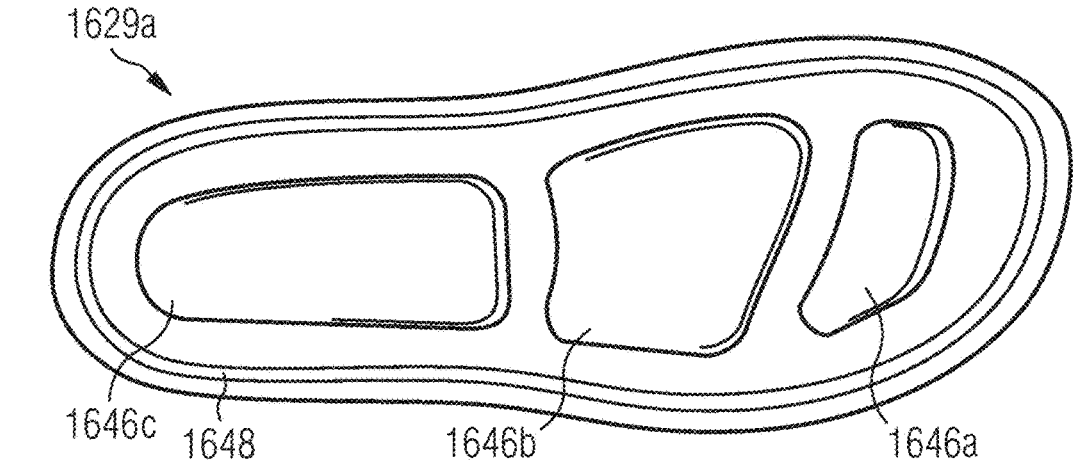

FIGS. 16*a*-16*b* depict embodiments of an insole 1629*a-b* in a top view comprising loose particles 1640*a-b* in accordance with the present invention. FIG. 16*c* depicts the insole 1629 in a rear view. The loose particles 1640*a-b* may be contained within a pouch, which characteristics are as discussed with reference to the pouch 1445 and 1545 of FIGS. 14*a* and 15. The loose particles 1640*a* may comprise a non-expanded material, in particular TPU, EVA, PET, PBT, or rubber in form of small spheres with a diameter ranging from 1 mm to 5 mm, or, in some embodiments, from 2 mm to 4 mm as depicted in FIG. 16*a*. Alternatively, the loose particles 1640*b* may comprise an expanded material as depicted in FIG. 16*b*, in particular at least one of the expanded materials listed above with reference to the fused particles 340 or loose particles 360 of FIG. 3. The size of the loose particles 1640*b* may be similar to the size of the loose particles 1640*a*. Based on the desired intensity of the massage effect, the softer expanded loose particles 1640*b* or the harder non-expanded loose particles 1640*a* may be selected for the various areas 1646*a-c* of the insole 1629*a*. A mixture of expanded 1640*b* and non-expanded 1640*a* loose particles may also be possible. Moreover, the intensity of the massage effect may further be adapted by a degree of filling of the pouch with at least one of: non-expanded or expanded loose particles, fluid, or a gas. The pouch may further be encapsulated into a soft material 1648 such as EVA, TPU, PET, PBT, or rubber. In this manner, in some embodiments of the present invention, the insole 1629*a-b* may be directly attached to a midsole of a shoe (not shown). Alternatively to an insole 1629*a*, 1629*b*, the loose particles 16140*a-b* may similarly be arranged within a midsole 1428, in particular a top section of a midsole 1428, of a shoe as depicted in FIG. 14*b*. In a further alternative embodiment, the loose particles 1640*a-b* may be provided within a separate insole 1629*a-b*, such as a sockliner, adapted to be insertable in any shoe of a respective size already owned by the user. In this manner, various insoles 1629*a-b* with a different number or arrangement of areas 1646*a-c* comprising loose particles 1640*a-b* may be exchangeable provided.

It may be noted that the features described above relating to loose particles 140, 240, 340, 540, 640, 1440 arranged in a midsole 120, 121, 122, 220, 221, 222, 320, 321, 322, 420, 421, 422, 520, 621, 722, 1428 for providing haptic feedback may be similarly arranged within an insole 1629*a-b* in accordance with the present invention or vice versa.

In the following, further embodiments are described to facilitate the understanding of the invention:

1. Sole for a shoe (100, 101, 102, 103, 500, 600, 1100), in particular a running shoe, comprising:
   a. a sole component; and
   b. at least one loose particles (140, 240, 340, 540, 640, 840, 940, 1040, 1140, 1440, 1640*a*, 1640*b*) contained within the sole component,
   c. wherein the loose particles provide haptic feedback to a user of the sole during an athletic activity.
2. Sole according to embodiment 1, wherein the sole component comprises a midsole (120, 121, 122, 220, 221, 222, 320, 321, 322, 420, 421, 422, 520, 621, 722, 823, 824, 825, 923, 924, 925, 1023, 1024, 1024, 1126, 1227, 1327, 1428) and/or an insole (1629*a*, 1629*b*).
3. Sole according to embodiment 1 or 2, wherein the sole component comprises particles of an expanded material (360, 460, 560, 660, 760, 960, 1060, 1160, 1260, 1360), in particular of expanded thermoplastic polyurethane, eTPU, which are fused at their surfaces.

4. Sole according to one of embodiments 1-3, wherein at least a portion of the sole component is manufactured by an additive manufacturing technique.
5. Sole according to one of embodiments 1-4, wherein the loose particles are at least partially arranged within a cavity (370, 470, 570, 670, 770, 870, 970, 1070, 1170, 1270, 1370) in the sole component.
6. Sole according to one of embodiments 1-5, wherein providing the haptic feedback does not involve any electronic components.
7. Sole according to one of embodiments 1-6, wherein the haptic feedback comprises feedback on a region of the user's foot where foot strike occurs, feedback on a roll-off behavior of the user's foot, feedback on a stride length of the user, feedback on a stride frequency of the user, a massage effect of the user's foot or a combination thereof.
8. Sole according to one of embodiments 1-7, wherein the loose particles comprise an expanded material, in particular expanded thermoplastic polyurethane, eTPU.
9. Sole according to one of embodiments 1-7, wherein the loose particles comprise a metal.
10. Sole according to one of embodiments 1-9, wherein the loose particles are generally spherical or ellipsoid in shape.
11. Sole according to one of embodiments 1-10, wherein the loose particles are contained within the sole component at least partly by a mesh-like material (450, 1050) disposed on a top side of the sole component.
12. Sole according to one of embodiments 2-11, wherein the loose particles are contained within the midsole at least partly by an outsole (530, 630, 1130, 1230, 1330) of the sole, in some embodiments, an outsole comprising a mesh-like material (550, 650, 1150) on the side facing the midsole.
13. Sole according to one of embodiments 1-8 and 10-12, wherein the loose particles are contained within a pouch (745*a*-745*f*) made of a mesh-like material (750).
14. Sole according to one of embodiments 1-8 and 10-12, wherein the loose particles are contained within a pouch (1445, 1545) made from a foil material.
15. Sole according to embodiment 14, wherein the pouch comprises a fluid (1447, 1547).
16. Sole according to one of embodiments 1-8 and 10-15, wherein the loose particles exhibit a different response to compression forces exerted by the foot of the user during use when compared to the surrounding material of the sole component.
17. Sole according to one of embodiments 1-8 and 10-16, wherein the loose particles are arranged in a forefoot region (273, 373, 473, 773) of the shoe to aid the user in achieving a forefoot running strike.
18. Sole according to one of embodiments 1-8 and 10-17, wherein the loose particles are arranged in a heel region (272, 372, 472, 672) of the shoe to aid the user in achieving a forefoot running strike.
19. Sole according to one of embodiments 1-7 and 9-12, wherein the loose particles change the effective weight of the sole during use of the sole.
20. Sole according to embodiment 19, wherein the effective weight of the sole depends at least partially on a stride frequency of the user.
21. Sole according to one of embodiments 1-7, 9-12, 19 and 20, wherein the loose particles can move along the longitudinal direction (874, 875, 974, 1074, 1274) of the sole.
22. Sole according to one of embodiments 1-7, 9-12 and 19-21, wherein the loose particles can move along a medial-to-lateral direction (876, 877, 976, 1076) of the sole.
23. Shoe (100, 101, 102, 103, 500, 600, 1100), in particular running shoe, comprising a sole according to one of the preceding embodiments.

Different arrangements of the components depicted in the drawings or described above, as well as components and steps not shown or described are possible. Similarly, some features and sub-combinations are useful and may be employed without reference to other features and sub-combinations. Embodiments of the invention have been described for illustrative and not restrictive purposes, and alternative embodiments will become apparent to readers of this patent. Accordingly, the present invention is not limited to the embodiments described above or depicted in the drawings, and various embodiments and modifications may be made without departing from the scope of the claims below.

That which is claimed is:

1. A sole for a shoe, the sole comprising:

a. a sole component comprising a midsole and/or insole, wherein the midsole and/or insole is formed from particles of an expanded material which are fused at their surfaces;

b. wherein the midsole and/or insole comprises a cavity, wherein the cavity is filled with an amount of loose particles formed from an expanded material; wherein the expanded material of the midsole and/or insole is the same expanded material as the expanded material of the loose particles;

c. wherein the loose particles provide haptic feedback to a user of the sole during an athletic activity and wherein the loose particles have a weight at least twice the weight of the surrounding midsole material of a same size;

d. wherein the loose particles are adapted to change an effective weight of the sole during use of the sole, the effective weight corresponding to a perceptible weight by a user; and e. wherein the expanded material is expanded ethylene-vinyl-acetate (eEVA), expanded thermoplastic urethane (eTPU), expanded polypropylene (ePP), expanded polyamide (ePA), expanded polyether block amide (ePEBA), expanded polyoxymethylene (ePOM), expanded polystyrene (ePS), expanded polyethylene (ePE), expanded polylactide (ePLA), expanded polyethylene terephthalate (ePET), expanded polybutylene terephthalate (ePBT), or expanded thermoplastic olefin (eTPO).

2. The sole according to claim 1, wherein at least a portion of the sole component is manufactured by an additive manufacturing technique.

3. The sole according to claim 1, wherein providing the haptic feedback does not involve any electronic components.

4. The sole according to claim 1, wherein the loose particles further comprise a metal.

5. The sole according to claim 1, wherein the loose particles are contained within the cavity at least partly by a mesh-like material disposed on a top side of the sole component.

6. The sole according to claim 1, wherein the loose particles are contained within the midsole at least partly by an outsole of the sole.

7. The sole according to claim 1, wherein the loose particles are contained in the cavity within a pouch made of a mesh-like material.

8. The sole according to claim 1, wherein the loose particles exhibit a different response to compression forces exerted by the foot of the user during use when compared to the surrounding material of the sole component.

9. The sole according to claim 1, wherein the loose particles are arranged in a forefoot region of the shoe to aid the user in achieving a forefoot running strike.

10. The sole according to claim 1, wherein the loose particles move along the longitudinal direction of the sole.

11. The sole according to claim 1, wherein the loose particles comprise expanded thermoplastic polyurethane (eTPU).

12. The sole according to claim 6, wherein the outsole comprises a mesh-like material on the side facing the midsole.

13. The sole according to claim 7, wherein the loose particles are contained within the pouch made from a foil material and comprising a fluid.

14. The sole according to claim 1, wherein the effective weight of the sole depends at least partially on a stride frequency of the user.

15. A shoe comprising the sole according to claim 1.

16. The sole according to claim 1, wherein the loose particles move along a medial-to-lateral direction of the sole.

17. The sole according to claim 1, wherein the loose particles are arranged in a heel region of the shoe to aid the user in achieving a forefoot running strike.

18. The sole according to claim 1, wherein the haptic feedback comprises feedback on a region of the user's foot where foot strike occurs, feedback on a roll-off behavior of the user's foot, feedback on a stride length of the user, feedback on a stride frequency of the user, a massage effect of the user's foot, or a combination thereof.

19. The sole according to claim 1, wherein the loose particles are contained in the cavity within a pouch made from a foil material.

* * * * *